US011060373B2

(12) United States Patent
Ellison

(10) Patent No.: US 11,060,373 B2
(45) **Date of Patent: *Jul. 13, 2021**

(54) WELL BORE CONTROL SYSTEM

(71) Applicant: Enovate Systems Limited, Aberdeen (GB)

(72) Inventor: Stuart Ellison, Dyce (GB)

(73) Assignee: ENOVATE SYSTEMS LIMITED, Aberdeen (GB)

( * ) Notice: Subject to any disclaimer, the term of this patent is extended or adjusted under 35 U.S.C. 154(b) by 5 days.

This patent is subject to a terminal disclaimer.

(21) Appl. No.: 16/408,984

(22) Filed: May 10, 2019

(65) Prior Publication Data

US 2019/0345789 A1 Nov. 14, 2019

Related U.S. Application Data

(63) Continuation of application No. 14/898,234, filed as application No. PCT/GB2014/051842 on Jun. 16, 2014, now Pat. No. 10,443,336.

(30) Foreign Application Priority Data

Jun. 14, 2013 (GB) ..... 1310613

(51) Int. Cl.
*E21B 33/06* (2006.01)

(52) U.S. Cl.
CPC ..... *E21B 33/062* (2013.01); *E21B 33/063* (2013.01)

(58) Field of Classification Search
CPC ..... E21B 33/06; E21B 33/062; E21B 33/063; E21B 33/08

(Continued)

(56) References Cited

U.S. PATENT DOCUMENTS 324,826 A ‡ 8/1885 Fritz ..... A63G 19/00 280/1
2,749,078 A ‡ 6/1956 Losey ..... E21B 33/062 277/32

(Continued)

FOREIGN PATENT DOCUMENTS

CN 101600847 A ‡ 12/2009
EP 0447707 9/1991

(Continued)

OTHER PUBLICATIONS

Australian Examination Report for corresponding Australian Serial No. 2017261568, dated Dec. 19, 2017, pp. 1-6.‡

(Continued)

*Primary Examiner* — Umashankar Venkatesan
(74) *Attorney, Agent, or Firm* — Tarolli, Sundheim, Covell & Tummino LLP

(57) ABSTRACT

The invention relates to a well bore control apparatus, system and method for sealing a well bore. The invention relates to a well bore control apparatus comprising a housing having a guide element defining a path, the housing defining a throughbore for receiving a tubular, a first tapered gate and a tapered second gate located within the housing, the first and second gates being adapted to engage with the guide element. In use the first and second gates are moveable along the path defined by the guide element in a direction substantially transverse to the throughbore between an open position of the throughbore and a closed position of the throughbore. The well bore control apparatus comprises a first seal seat for forming a first seal with the first gate in the closed position to seal the throughbore. The well bore control apparatus may include a second seal seat. The second seal seat may be adapted for forming a second seal (Continued)

with the second gate in the closed position to seal the throughbore.

26 Claims, 21 Drawing Sheets

(58) Field of Classification Search
USPC ..... 251/1.1, 1.2, 1.3
See application file for complete search history.

(56) References Cited

U.S. PATENT DOCUMENTS

| | | | | |
|---|---|---|---|---|
| 2,787,252 | A ‡ | 4/1957 | Papanoli | B26D 7/22 92/27 |
| 2,986,367 | A ‡ | 5/1961 | Le Rouax | E21B 33/06 251/1.3 |
| 3,561,526 | A ‡ | 2/1971 | Williams, Jr. | E21B 29/08 137/68.14 |
| 4,140,041 | A ‡ | 2/1979 | Frelau | B21D 26/08 137/68 |
| 4,437,643 | A ‡ | 3/1984 | Brakhage, Jr. | E21B 33/062 251/1 |
| 4,580,628 | A ‡ | 4/1986 | Schaeper | E21B 29/02 166/85 |
| 5,022,472 | A ‡ | 6/1991 | Bailey | E21B 33/085 166/84.3 |
| 5,056,418 | A ‡ | 10/1991 | Granger | E21B 33/062 251/1 |
| 5,931,442 | A ‡ | 8/1999 | Cummins | B63C 11/52 166/298 |
| 7,552,765 | B2 ‡ | 6/2009 | Lam | |
| 8,353,338 | B2 ‡ | 1/2013 | Edwards | F16K 3/029 166/55 |
| 8,573,557 | B2 ‡ | 11/2013 | Carbaugh | E21B 33/062 166/86.2 |
| 8,740,174 | B2 ‡ | 6/2014 | Juda | E21B 33/062 251/1.3 |
| 9,249,643 | B2 ‡ | 2/2016 | Melancon | E21B 33/063 |
| 2003/0026395 | A1 ‡ | 2/2003 | Snow | H04M 3/493 379/93 |
| 2006/0169933 | A1 ‡ | 8/2006 | Le | F15B 15/261 251/1 |
| 2008/0135791 | A1 ‡ | 6/2008 | Juda | E21B 33/062 251/1.3 |
| 2016/0102518 | A1 ‡ | 4/2016 | Araujo | A47G 19/2266 251/1.3 |

FOREIGN PATENT DOCUMENTS

| | | | |
|---|---|---|---|
| EP | 0447707 | A1 ‡ | 9/1991 |
| GB | 2454850 | B ‡ | 9/2006 |
| GB | 2454850 | | 1/2011 |
| WO | 99/25611 | A1 ‡ | 11/1997 |
| WO | 9925611 | | 5/1999 |
| WO | 2013/002971 | A2 ‡ | 1/2013 |

OTHER PUBLICATIONS

Australian Examination Report for corresponding Australian Serial No. 2014279794, dated Mar. 20, 2017, pp. 1-3.‡
Chinese Office Action for corresponding Chinese Serial No. 2014800443173, dated Sep. 29, 2018, pp. 1-10.‡
IPO Search Report for corresponding Application Serial No. GB1310613.3, dated Nov. 27, 2013, pp. 1-4.‡
International Search Report and Written Opinion to corresponding Int'l Pat, Appl, No. PCT/GB2014/051842, dated Jun. 5, 2015, 20 pages.‡
Australian Examination Report for corresponding Australian Serial No. 2017261567, dated Dec. 19, 2017, pp. 1-5.
International Search Report and Written Opinion dated Jun. 5, 2015 for corresponding International Application No. PCT/GB2014/051842.
Australian Examination Report for corresponding Australian Serial No. 2014279794, dated Mar. 20, 2017.
Australian Examination Report for corresponding Australian Serial No. 2017261568, dated Dec. 19, 2017.
Australian Examination Report for corresponding Australian Serial No. 2017261567, dated Dec. 19, 2017.
Canadian Office Action for corresponding Canadian Application No. 2915074, dated Aug. 25, 2020.

‡ imported from a related application 68a
32
72
42
23
28
30
66a
64a
44
64b
67a
67b Gate : Seat = Metal to Metal Seal
Seat : Housing = Metal to Metal Seal

WELL BORE CONTROL SYSTEM

RELATED APPLICATIONS

The present application is a Continuation of U.S. patent application Ser. No. 14/898,234, filed on Dec. 14, 2015, which is a U.S. National Stage Application under 35 USC 371, claiming priority to PCT Serial No. PCT/GB2014/051842, filed on Jun. 16, 2014; which claims priority to GB Patent Application Serial No. 1310613.3, filed on Jun. 14, 2013, the entirety of all of which are incorporated herein by reference.

FIELD OF THE INVENTION

The present invention relates to a well bore control system for sealing a well bore and particularly, but not exclusively, for sealing a well bore through which a tubular such as a workover or drilling conduit or intervention tool passes.

BACKGROUND OF THE INVENTION

In the oil and gas industry, production or exploration wells are provided with one or more well bore control devices, such as a blow out preventer or riser control device for sealing the well bore in the event of an emergency in order to protect personnel and the environment.

Most well bore control devices are known as blow out preventers (BOPs) and include various sets of rams. There are three basic types; pipe rams for closing around a pipe or tubular passing through the well bore control device, blind rams for sealing the well bore in the absence of a tubular passing through the device and shear rams for cutting through any tubular present in the well bore. All sets of rams are mounted perpendicular to the well bore, which is vertically orientated. In the event of a blow out from an over pressure situation in the well, the shear rams can be activated to sever a tubular disposed in the well bore and passing through the well bore control device and so seal the well bore and prevent escape of well fluids. Shear rams are actuated to move in a horizontal plane and are driven by in line pistons. Most existing BOPs and well bore control devices have a number of drawbacks, for example, sealing is generally achieved using elastomeric seals and these seals can be limited with more aggressive wells with high temperature and high pressure fluid requiring containment. In addition, the existing structure of inline pistons creates a very large and heavy structure which can be difficult to manoeuvre and expensive to manufacture.

Improved sealing of a well bore can be achieved by using valves to seal the throughbore, but most available valves, such as ball valves with a hardened cutting edge, can only cut through a very limited range of tubulars or conduits and generally most of these are a relatively small diameter 2 to 3 inches, such as coil tubing.

UK patent GB2454850B discloses an improved well bore control valve which is more compact than traditional BOPs in which cutting gates and actuators are arranged in parallel to reduce the overall length of the device. Operation of the actuators pulls cutting blades and gates across the throughbore in opposite directions to provide a shear force to cut tubulars in the well bore and subsequently the gates seal the well and engage two separate seals to provide independent metal to metal seals.

It is desirable to provide further modifications to the aforementioned well bore control device to provide further enhancements in sealing, seal maintenance and replacement and general device maintenance.

SUMMARY OF THE INVENTION

According to a first aspect of the present invention there is provided a well bore control apparatus comprising:

- a housing having a guide element defining a path, the housing defining a throughbore for receiving a tubular;
- a first tapered gate and a tapered second gate located within the housing, the first and second gates being adapted to engage with the guide element, wherein in use the first and second gates are moveable along the path defined by the guide element in a direction substantially transverse to the throughbore between an open position of the throughbore and a closed position of the throughbore; and
- a first seal seat for forming a first seal with the first gate in the closed position to seal the throughbore.

The well bore control apparatus may include a second seal seat. The second seal seat may be adapted for forming a second seal with the second gate in the closed position to seal the throughbore.

The first and/or second seal may minimise or prevent flow of fluids, such as well bore fluids, through the throughbore.

The guide element may be arranged, in use, to actuate the first and/or second gate into sealing engagement with the first respective first and/or second seal seat in the closed position. For example, in the closed position the first and/or second gate may abut the respective first and/or second seal seats to form the first and/or second seals. By arranging the guide element so as to actuate the first and/or second gate into sealing engagement with the respective first and/or second seal seat, the throughbore may be sealed when either the first or the second gate is in the closed position. Alternatively or additionally, the throughbore may be sealed when both the first and second gates are in the closed position.

The guide element may cause displacement of the first and/or second gate, in a direction perpendicular to the substantially transverse movement of the first and/or second gate, when the first and/or second gate are moved from the open position to the closed position. The displacement of the first and/or second gate caused by the guide element may be in a direction parallel to the throughbore. The displacement of the first and/or second gate may create a deflection of material within the respective first and/or second seal seat, which may energise the first and/or second seal.

The guide element may actuate the first and second gates so that the first and second gates provide the first and second seal independently from each other in the closed position. By arranging the first and second gates to independently seal the throughbore in the closed position, a failsafe well bore control apparatus may be provided.

A taper of the first and second gates may allow for the first and second gates to co-act with each other, for example, when the first and second gates are in the closed position.

The guide element may be arranged in the housing in a substantially transverse direction to the throughbore. The guide element may be inclined or declined with respect to a longitudinal axis of the housing. The guide element may be arranged within the housing to define an acute angle to the longitudinal axis of the housing.

In some embodiment, the guide element may have a protrusion, recess and/or groove, e.g. an elongated protrusion, recess and/or groove. The protrusion, recess and/or groove may be arranged in the housing in a substantially transverse direction to the throughbore. In other examples, the guide element may have a plurality of protrusions, recesses and/or grooves, e.g. elongated protrusions, recesses and/or grooves. The plurality of protrusions, recesses and/or grooves may be arranged in the housing in a substantially transverse direction to the throughbore. Each protrusion, recess and/or groove of the plurality of protrusions, recesses and/or grooves may be arranged parallel to one another.

The housing may include one or more guide elements. In some embodiment, the housing may comprise a first and a second guide element. The first and second guide elements may be provided in the housing so as to oppose one another. For example, the first and second guide element may be provided on two opposing surfaces within the housing.

The first and/or second gate may be adapted to engage with the guide element. The first and/or second gate may include an engagement element. The engagement element may be provided on the first and/or second gate. The engagement element may be arranged for mating, interoperating and/or co-acting with the guide element of the housing. In some embodiments, the engagement element may have a further protrusion, recess and/or groove, e.g. for mating, interoperating and/or co-acting the respective protrusion, recess and/or groove of the guide element. In other embodiments, the engagement element may have a plurality of further protrusions, recesses and/or grooves, e.g. for mating, interoperating and/or co-acting with the respective plurality of protrusions, recesses and/or grooves of the guide element. In some embodiments, the engagement element is in line or aligned with the taper of the first and/or second gate.

The first and/or second gate may include one or more of engagement elements. The plurality of engagement elements may be arranged for mating, interoperating and/or co-acting with one or more guide elements of the housing. In some embodiments, the first and/or second gate may have a first and a second engagement element. The first and second engagement elements may be provided on opposing sides or surfaces of the first and/or second gate. The first and second engagement elements may be provided on the first and/or second gate to mating, interoperating and/or co-acting with the respective first and second guide elements of the housing.

The engagement element may be arranged on the first and/or second gate along length or in a longitudinal direction of the first and/or second gate. The engagement element may be inclined or declined with respect to a longitudinal axis of the first and/or second gate. The engagement element may be arranged on the first and/or second gate to define an acute angle to the longitudinal axis of the first and/or second gate.

In some embodiments, the acute angle defines by the engagement element may be the same as the acute angle defined by the guide element. In other embodiments, the acute angle defines by the engagement element may differ from the acute angle defined by the guide element.

The first and/or second gate may include first and/or second metal gate. The first and/or second seal seat may include first and/or second metal seal seat. In the closed position, the first and/or second gate engage or abut the respective first and/or second seal seat to form a respective first and/or second metal to metal seal.

In the closed position, the first and/or second gate and/or the first and/or second engagement element may engage or abut the guide element and/or the housing to form a further first and/or second seal, e.g. a further first and/or second metal to metal seal, between the first and/or second gate and the guide element and/or housing.

The first and/or second gate may include a respective first shearing elements and/or a respective second shearing element. The first and/or second shearing element may be provided on an end of the respective first and/or second gate. The first and/or second shearing elements may be adapted for severing a tubular contained in the throughbore. For example, when the first and/or second gates move from the open position to the closed position, the first and/or second shearing element may server the tubular contained in the throughbore.

The well bore control apparatus may include a first gate actuator and/or a second gate actuator. The first and/or second gate actuator may be included in the housing. The first and/or second gate actuators may be coupled to the respective first and/or second gates for moving the first and/or second gate between the open and the closed position.

According to a second aspect there is provided a wellbore control apparatus comprising:

- a housing defining a throughbore for receiving a tubular;
- a first gate and a second gate being movable in a direction transverse to the throughbore between an open position of the throughbore and a closed position of the throughbore, in use;
- a first actuator portion, the first actuator portion comprising a first gate actuator coupled to the first gate for moving the first gate between the open and the closed position;
- a second actuator portion, the second actuator portion having a second gate actuator coupled to the second gate for moving the second gate between the open and the closed position; and
- a coupling arrangement for securing and/or fastening the first and second actuator portions to one another.

The first and/or second actuator portion may be part of the housing. The first and second actuator portions, otherwise defined as pistons, may be coaxially arranged within the housing. The first and second actuator portions may be provided external of the throughbore.

The coupling arrangement may be arranged to bias and/or pull the first and second portions to one another. The coupling arrangement may be arranged to bias and/or pull the first and second actuator portions to one another in a longitudinal direction of the housing. The coupling arrangement may bias and/or pull the first and second actuator portions inwards and/or towards the throughbore. The coupling arrangement may exert or apply an inwardly directed force and/or load, e.g. a force and/or load towards the throughbore, on the first and second actuator portions.

In use, the first and second actuators may be at least partially actuated outwards, when the first and second gates move from the open to the closed position of the throughbore. The first and second actuators may exert or apply an outwards directed force and/or load, e.g. a force and/or load directed away from the throughbore, on the first and second actuator portions, in use. For example, when the first and second actuator i.e. pistons move the respective first and second gates into the closed position, an outwardly directed force and/or load may act on the first and second actuator portions.

In use, a force and/or load exerted by the coupling arrangement on the first and second actuator portions may be in an opposite or reversed direction to a force and/or load exerted on the first and second actuator portions by the first and second actuators, e.g. when the first and second gates are moved to the closed position.

In use, the coupling arrangement may provide a load path for the forces and/or loads acting on the first and second actuator portions and/or the housing. In use, the coupling arrangement may minimise or prevent movement, such as outwards movement, of the first and second actuator portions, when the first and second gates are moved or actuated from the open position to the closed position of the throughbore by the respective first and second pistons, moving away from the throughbore.

The coupling arrangement may be provided external of the throughbore. The coupling arrangement may extend in a longitudinal direction of the housing, first and/or second actuator portions. The coupling arrangement may comprise one or more elongate member. Each of the one or more elongate members may comprise a first portion and a second portion. Each first portion of the one or more elongate member may be provided on or extend from the first actuator portion. Each second portion of the one or more elongate member may be provided on or extend from the second actuator portion. Each of the first and second portions of the one or more elongate members may be arranged to oppose one another. In some examples, each first and second portion of the one or more elongate members may comprise a thread, such as a screw thread or the like.

The coupling arrangement may comprise one or more connection members. The one or more connection members may be adapted for connecting together the respective first and second portions of the one or more elongate members. The one or more connection members may each have a further first and second thread, such as a screw thread or the like. The first and second thread of each of the one or more connection member may engage and/or co-act with the thread of each of the first and second portion of the one or more elongate members.

The one or more connection members may be adapted to adjust and/or vary tension acting between first and/or second actuator portions. For example, the one or more connection members may be adapted to adjust and/or vary tension acting between respective first and second portions of the one or more elongate members and/or between the first and second actuator portions. For example, tension between the first and second portions of the one or more elongate members and/or first and second actuator portions may be varied, for example by moving or rotating the one or more connection members to move or pull the first and second actuator portions together or by moving or rotating the one or more connection members to release tension between the first and second actuator portions.

Features defined above in relation to the first aspect may be applied to the second aspect.

According to a third aspect of the present invention there is provided a well bore control apparatus comprising:

- a housing having a guide element defining a path, the housing defining a throughbore for receiving a tubular;
- a first gate and a second gate located within the housing, the first and second gates being adapted to engage with the guide element, wherein in use the first and second gates are moveable along the path defined by the guide element in a direction substantially transverse to the throughbore between an open position of the throughbore and a closed position of the throughbore; and
- a first seal seat for forming a first seal with the first gate in the closed position to seal the throughbore.

The well bore control apparatus may include a second seal seat. The second seal seat may be adapted for forming a second seal with the second gate in the closed position to seal the throughbore.

The first and/or second seal may minimise or prevent flow of fluids, such as well bore fluids, through the throughbore.

The guide element may be arranged, in use, to actuate the first and/or second gate into sealing engagement with the first respective first and/or second seal seat in the closed position. For example, in the closed position the first and/or second gate may abut the respective first and/or second seal seats to form the first and/or second seals. By arranging the guide element so as to actuate the first and/or second gate into sealing engagement with the respective first and/or second seal seat, the throughbore may be sealed when either the first or the second gate is in the closed position. Alternatively or additionally, the throughbore may be sealed when both the first and second gates are in the closed position.

The guide element may cause displacement of the first and/or second gate, in a direction perpendicular to the substantially transverse movement of the first and/or second gate, when the first and/or second gate are moved from the open position to the closed position. The displacement of the first and/or second gate caused by the guide element may be in a direction parallel to the throughbore. The displacement of the first and/or second gate may create a deflection of material within the respective first and/or second seal seat, which may energise the first and/or second seal.

The guide element may actuate the first and second gates so that the first and second gates provide the first and second seal independently from each other in the closed position. By arranging the first and second gates to independently seal the throughbore in the closed position, a failsafe well bore control apparatus may be provided.

The guide element may be arranged in the housing in a substantially transverse direction to the throughbore. The guide element may be inclined or declined with respect to a longitudinal axis of the housing. The guide element may be arranged within the housing to define an acute angle to the longitudinal axis of the housing.

In some embodiment, the guide element may have a protrusion, recess and/or groove, e.g. an elongated protrusion, recess and/or groove. The protrusion, recess and/or groove may be arranged in the housing in a substantially transverse direction to the throughbore. In other embodiments, the guide element may have a plurality of protrusions, recesses and/or grooves, e.g. elongated protrusions, recesses and/or grooves. The plurality of protrusions, recesses and/or grooves may be arranged in the housing in a substantially transverse direction to the throughbore. Each protrusion, recess and/or groove of the plurality of protrusions, recesses and/or grooves may be arranged parallel to one another.

The housing may include one or more guide elements. In some embodiment, the housing may comprise a first and a second guide element. The first and second guide elements may be provided in the housing so as to oppose one another. For example, the first and second guide element may be provided on two opposing surfaces within the housing.

The first and/or second gate may be adapted to engage with the guide element. The first and/or second gate may include an engagement element. The engagement element may be provided on the first and/or second gate. The engagement element may be arranged for mating, interoperating and/or co-acting with the guide element of the housing. In some embodiments, the engagement element may have a further protrusion, recess and/or groove, e.g. for mating, interoperating and/or co-acting the respective protrusion, recess and/or groove of the guide element. In other embodiments, the engagement element may have a plurality of further protrusions, recesses and/or grooves, e.g. for mating, interoperating and/or co-acting with the respective plurality of protrusions, recesses and/or grooves of the guide element. In some embodiments, the engagement element is in line or aligned with the taper of the first and/or second gate.

The first and/or second gate may include one or more of engagement elements. The plurality of engagement elements may be arranged for mating, interoperating and/or co-acting with one or more guide elements of the housing. In some embodiments, the first and/or second gate may have a first and a second engagement element. The first and second engagement elements may be provided on opposing sides or surfaces of the first and/or second gate. The first and second engagement elements may be provided on the first and/or second gate to mating, interoperating and/or co-acting with the respective first and second guide elements of the housing.

The engagement element may be arranged on the first and/or second gate along length or in a longitudinal direction of the first and/or second gate. The engagement element may be inclined or declined with respect to a longitudinal axis of the first and/or second gate. The engagement element may be arranged on the first and/or second gate to define an acute angle to the longitudinal axis of the first and/or second gate.

In some embodiments, the acute angle defines by the engagement element may be the same as the acute angle defined by the guide element. In other embodiments, the acute angle defined by the engagement element may differ from the acute angle defined by the guide element.

The first and/or second gate may be tapered or include a taper. The taper may allow for the first and second gates to co-act with each other, for example, when the first and second gates are in the closed position. In some embodiments, the engagement element is in line or aligned with the taper of the first and/or second gate.

The first and/or second gate may include first and/or second metal seals. The first and/or second seal seat may include a first and/or second metal seal seat. In the closed position, the first and/or second gate may engage or abut the respective first and/or second seal seat to form a respective first and/or second metal to metal seal.

In the closed position, the first and/or second gate and/or the first and/or second engagement element may engage or abut the guide element and/or the housing to form a further first and/or second seal, e.g. a further first and/or second metal to metal seal, between the first and/or second gate and the guide element and/or housing.

The first and/or second gate may include a respective first shearing elements and/or a respective second shearing element. The first and/or second shearing element may be provided on an end of the respective first and/or second gate. The first and/or second shearing elements may be adapted for severing a tubular contained in the throughbore. For example, when the first and/or second gates move from the open position to the closed position, the first and/or second shearing element may server the tubular contained in the throughbore.

The well bore control apparatus may include a first gate actuator and/or a second gate actuator. The first and/or second gate actuator may be included in the housing. The first and/or second gate actuators may be coupled to the respective first and/or second gates for moving the first and/or second gate between the open and the closed position.

Features defined above in relation to the first and/or second aspect may be applied to the third aspect.

According to a fourth aspect of the present invention there is provided a method for sealing a well bore, the method comprising:

providing a well bore control apparatus according to the first aspect of the present invention;

actuating or moving a first and/or second gate in a direction transverse to a throughbore from an open position of the throughbore to a closed position of the throughbore;

engaging the first gate with a first seal seat; and forming a first seal between the first gate and the first seal seat to seal or close the throughbore.

The first seal may prevent or minimise flow of fluid, such as wellbore fluids, through the throughbore.

The method may include actuating or moving the first gate along a path defined by a guide element. The guide element may be located in a housing of the well bore control apparatus. The guide element may actuate the first gate into sealing engagement with the first seal seat.

The method may include engaging the second gate with a second seal seat.

The method may include forming a second seal between the second gate and the second seal seat to seal or close the throughbore.

The method may comprise actuating or moving the second gate along the path defined by the guide element. The guide element may guide the second gate into sealing engagement with the second seal seat.

Features defined above in relation to the first, second and/or third aspect may be applied to the fourth aspect.

According to a fifth aspect there is provided a method for connecting, securing and/or fastening together first and second actuator portions of a well bore control apparatus, the method comprising:

providing a well bore control apparatus according to the third aspect of the present invention; and connecting, securing and/or fastening together first and second actuator portions using a coupling arrangement.

The step of connecting, securing and/or fastening together first and second actuator portions may include connecting together first and second portions of one or more elongate members provided on or extending from the respective first and second actuating portions, for example by one or more connection members. In some embodiments, each first and second portion of the one or more may have a thread, such as a screw thread or the like. The one or more connection members may each have a first and second thread. The first and second thread of each of the one or more connection member may engage and/or co-act with the thread of each of the first and second elongate members.

The method may include minimising and/or restricting movement, such as outwards movement, of the first and second actuator portions, e.g. when the first and second gates are moved or actuated from the open position to the closed position of the throughbore by the respective first and second actuators. A force and/or load exerted by the coupling arrangement on the first and second actuator portions may be in an opposite or reversed direction to a force and/or load exerted on the first and second actuator portions by the first and second actuators, when the first and second gates are moved or actuated from the open position to the closed position of the throughbore.

The method may include adjusting and/or varying tension acting between respective first and second portions of the one or more elongate members and/or between the first and second actuator portions. For example, tension between the first and second portions of the one or more elongate members and/or first and second actuator portions may be varied, for example by moving or rotating the one or more connection members to move or pull the first and second together or by moving or rotating the one or more connection members to release tension between the first and second actuator portions.

Features defined above in relation to the first, second, third and/or fourth aspect may be applied to the fifth aspect.

According to a sixth aspect of the present invention there is provided a coupling arrangement for connecting, securing and/or fastening together first and second actuator portions of a well bore control apparatus according to the second aspect of this invention.

The coupling arrangement may comprise any of the features of the second and/or fifth aspect.

In accordance with a seventh aspect of the present invention there is provided a well bore control apparatus comprising: a housing defining a throughbore, the throughbore adapted to receive a tubular, first and second gates each having a shearing element located within the housing, the gates being moveable in use, in different directions transverse to the throughbore between a though bore open position and a throughbore closed position to shear a tubular located within the throughbore; and a first seal seat for forming a seal with a first gate in the throughbore closed position to seal the throughbore; the housing having first and second gate actuators coupled to the respective first and second gates for moving said first and second gates between the open and the closed position, the gate actuators each having a removable element for providing access to the interior of the well bore control apparatus.

Preferably, there is a second seal seat for forming a seal with the other of said gates.

Conveniently, each actuator is substantially hollow and has an end plate coupled thereto, the end plate being independently removable.

Preferably said first and second gates are tapered so that, in use, when said gates move to a closed position the tapered gates slide over each other to cause displacement parallel to the throughbore and cause the surfaces of the gates adjacent the seals to abut the seals and energise the sealing.

Conveniently, said seal seats are metal and said gates are metal so that abutment of the gates with the seal seats provides a metal to metal seal when the apparatus is actuated and the gates are closed. Also, abutment of the seal seat against the housing provides metal to metal seals.

Preferably also, said first and second gate actuators are lockable in an open position or in a closed position. Conveniently, this is achieved by providing a plurality of spring loaded dogs which are biased to engage receiving positions in said actuator, said dogs being movable hydraulically to a release position when it is desired to move said gates between said open and said closed position.

Features defined above in relation to the first, second and/or third aspect may be applied to the seventh aspect.

According to eighth aspect of the invention there is provided a well bore control apparatus comprising a housing defining a throughbore, the throughbore adapted to receive a tubular; first and second cutting gates located within the housing, the gates being moveable in use, in different directions transverse to the throughbore between a throughbore open position and a throughbore closed position to shear a tubular located within the throughbore and a first seal seat for forming a seal with one of the gates in the throughbore closed position to seal the throughbore; the housing having first and second gate actuators coupled to respective first and second gates for moving the first and second gates between a well bore open and a well bore closed position the gate actuators each having a removable element for providing access to the interior of the well bore control apparatus, said removable element being coupled to a shear ram assembly.

Conveniently, said shear ram assembly comprises a drive portion, a travelling block portion, a cutting blade and a sealing gate. Preferably also, each of said sealing gates is tapered.

Preferably also, said seals are metal seals and said gates are metal, thus providing metal to metal seals when said well bore control apparatus is in the closed position.

Conveniently, said removable element is coupled to a respective actuator and to the ram shear assembly, said element being free to move relative to the housing defining the free bore. Conveniently, said removable element is secured to a hollow piston actuator.

Preferably also, said removable element is coupled to said hollow piston actuated by means of a plurality of C-rings which are disposed in grooves between said removable element and said actuator. Conveniently, there are spaced grooves in each of said actuator and said removable element and a C-ring is disposed in each respective pair of grooves to ensure that said removable element is securely fastened to said actuator. Conveniently, said actuator or said removable element have a plurality of slots based around the periphery for receiving elements for displacing the C-rings to free the removable element from the actuator and thus allow the removable element with associated shear ram assembly to be removed from the well bore control apparatus.

Conveniently, slots are placed around the periphery for receiving wedges for displacing the C-rings.

Alternatively, a rotatable cam means may be provided with cam surfaces for engaging with the C-rings so that rotation of the cam carrying element will cause the cam surfaces to abut the C-rings and in response to the displacement of the cam surfaces the C-rings will be displaced into the grooves to allow the removable end element and associated shear ram assembly to be removed from the well bore control apparatus.

Features defined above in relation to the first, second, third and/or seventh aspect may be applied to the eighth aspect.

According to a ninth aspect of the invention there is provided a mechanism for locking the position of a reciprocating piston with a hydraulic cylinder, said mechanism comprising a housing defining a volume for receiving a piston, said piston being movable within the volume between first and second positions, such that in a first position it defines a first volume for extending the piston and in the second position it defines a second volume for retracting the piston, said piston and said housing having a sealing arrangement separating said first and second volumes to create a third volume, said third volume being disposed between said piston seals and said third volume travelling with movement of said piston, each of said first, second and third volumes being coupled to hydraulic ports for receiving hydraulic fluid under pressure, said piston having spaced recesses for receiving at least one locking dog to lock said piston in said closed position or in an open position, said at least one locking dog being normally biased to engage with the recess in said piston to lock said piston in a first or second position and said locking dog being displaceable by actuation of hydraulic pressure to said third volume to bias said locking dog against a spring load and permit pressure to be applied to said first volume or to said second volume for displacing said piston within said housing.

Said housing is cylindrical and there are a plurality of spring biased locking dogs disposed equally around the periphery of the housing for engagement with respective recesses in said cylindrical piston.

According to a tenth aspect of the invention there is provided a further coupling arrangement for coupling a first body and a second body together, both bodies being circular and one body being denoted as the female body and the other body being denoted as the male body, the female body having an interior circular surface having a plurality of space grooves therein and the male body also having a circular surface of substantially the same diameter of the interior surface of said female body and having an equal number of similarly sized grooves therein, said grooves in said male and female bodies being equally spaced and being adapted to receive a C-ring, which are installed in the grooved of either said male or female body, a plurality of slots located in either of said male body or said female body which intersect with the circumferential grooves, the slots being adapted to receive a plurality of elements for engaging with the C-rings in said circumferential grooves and displacing said C-rings to permit the male and female bodies to be disengaged.

Alternatively, the axial slots are replaced by shafts carrying cam surfaces for engagement with the grooves such that rotation of the shafts causes the cam surfaces to displace the C-rings and allow the male and female elements to be disengaged.

According to a eleventh aspect of the invention, there is provided a method of servicing the interior of a well bore control apparatus according to the first aspect of the invention, said method comprising the steps of removing an end cover of a well bore control apparatus, said end cover being coupled to a shear ram assembly, removing said end cover and said shear ram assembly to permit replacement of a cutting blade, a sealing gate or a valve seal.

Preferably, the method includes decoupling the end cover from a hollow cylindrical actuator using wedges to displace C-rings. Alternatively, the method includes decoupling the end cover from a hollow cylindrical actuator using cam surfaces to displace locking C-rings.

Preferably, also included is a method of improving a metal to metal sealing arrangement using a well bore control apparatus comprising providing metal sealing gates with tapered surfaces, in response to closing said well bore control apparatus energising metal to metal sealing between a top metal seal and a first gate surface and between a bottom metal seal and a gate surface such that the seals are in a state of high compressive preload.

Preferably, also said first and said second seal seats engage the housing to form further metal to metal seals.

BRIEF DESCRIPTION OF THE DRAWINGS

It should be understood that the features defined above in accordance with any aspect of the present invention or below in relation to any specific embodiment of the invention may be utilised, either alone or in combination with any other defined feature, in any other aspect or embodiment of the invention.

These and other aspects of the invention will become apparent from the following description when taken in combination with the accompanying drawings in which.

DETAILED DESCRIPTION OF THE INVENTION

Figure 1:
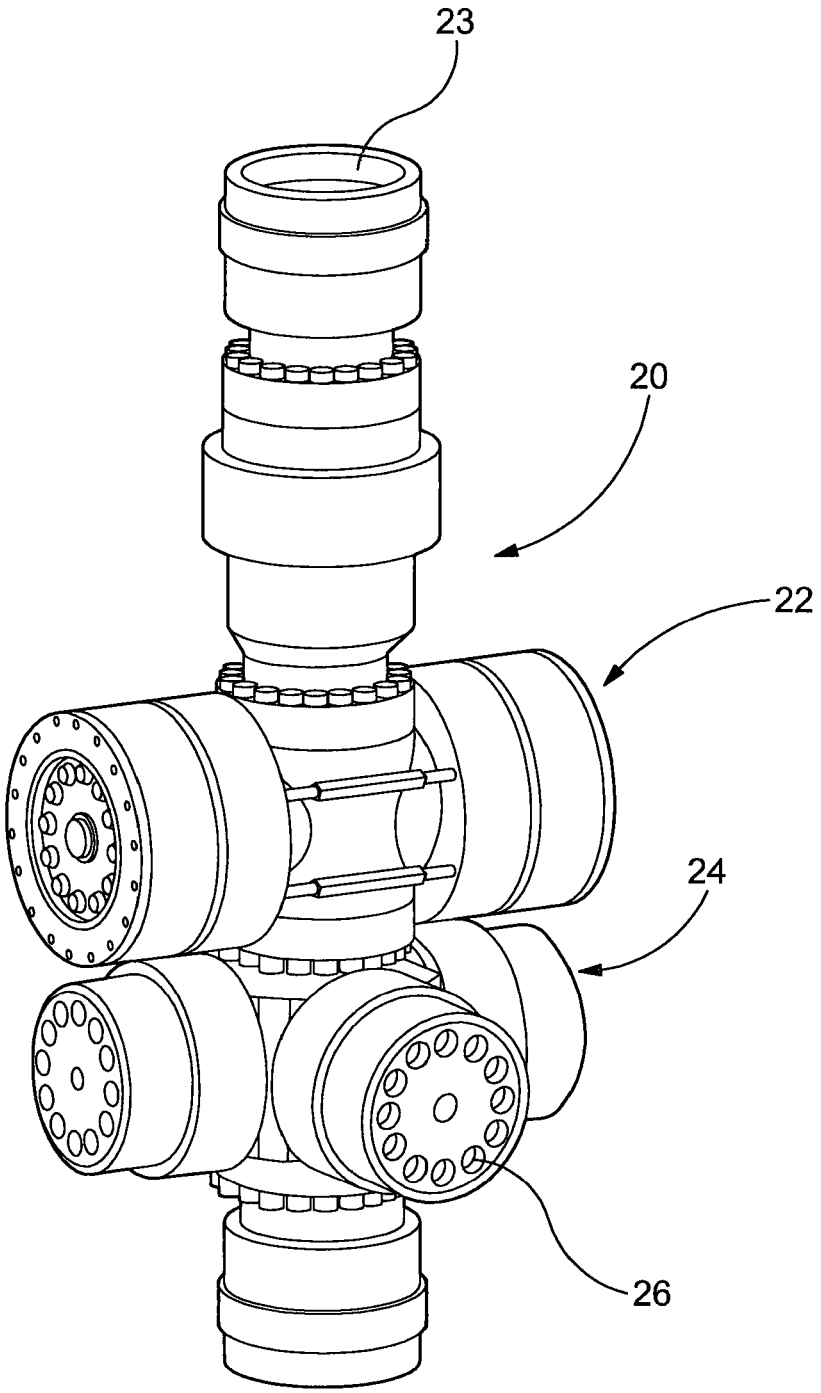
FIG. 1 is a perspective view of a well control system with a well bore control apparatus located above a set of pipe rams.

Reference is first made to FIG. 1 of the drawings which depicts a blow out preventer (BOP) stack generally indicated by reference numeral 20, which consists of a well bore control system provided by a well bore control apparatus 22 in accordance with an embodiment of the present invention, which has a pair of shear rams, as will later be described in detail, for closing a well bore 23 in the event of an emergency, and two sets of pipe rams 24, 26 disposed orthogonally to each other and disposed on the BOP stack 20 beneath the well bore control apparatus 22.

Figure 2:
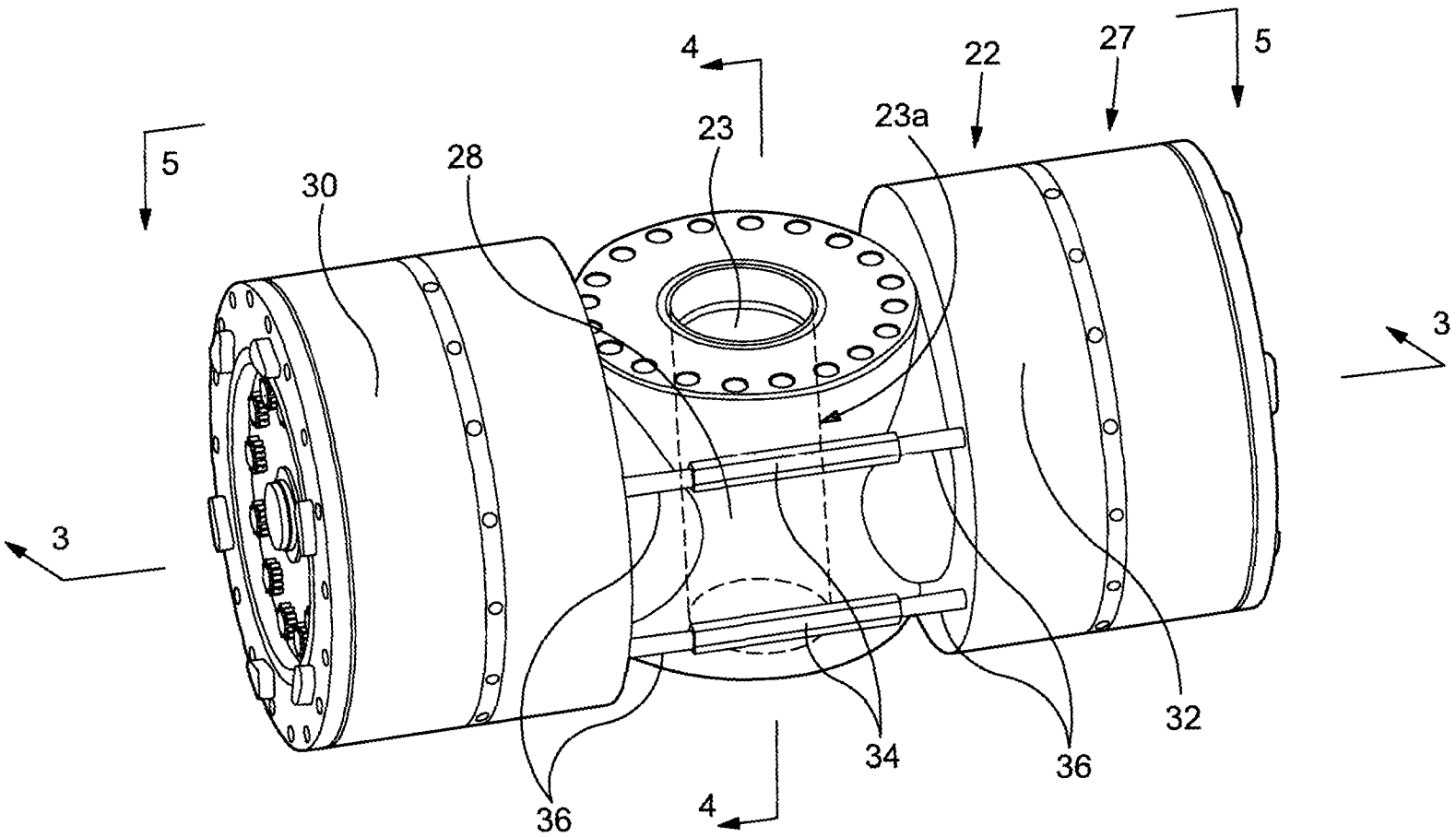
FIG. 2 is an enlarged view of the well bore control apparatus shown in FIG. 1 with the device in the open position.

Reference is now made to FIG. 2 of the drawings which depict an enlarged view of the apparatus 22 shown in FIG. 1. The well bore control apparatus consists of a housing 27, including a main steel body 28 and two cylindrical actuator housings generally indicated by reference numerals 30 and 32 which are fastened together by a coupling arrangement 34, which will be described in more detail below.

As will be later explained in detail, the ends 30 and 32 contain actuators for actuating shear rams carrying cutting blades and sealing gates to move between an open position and a closed position. The actuators and rams are arranged so that for the position shown in FIG. 2 the gates are in the open position and the bore 23 is open, as shown in broken outline 23*a*.

Figure 3A:
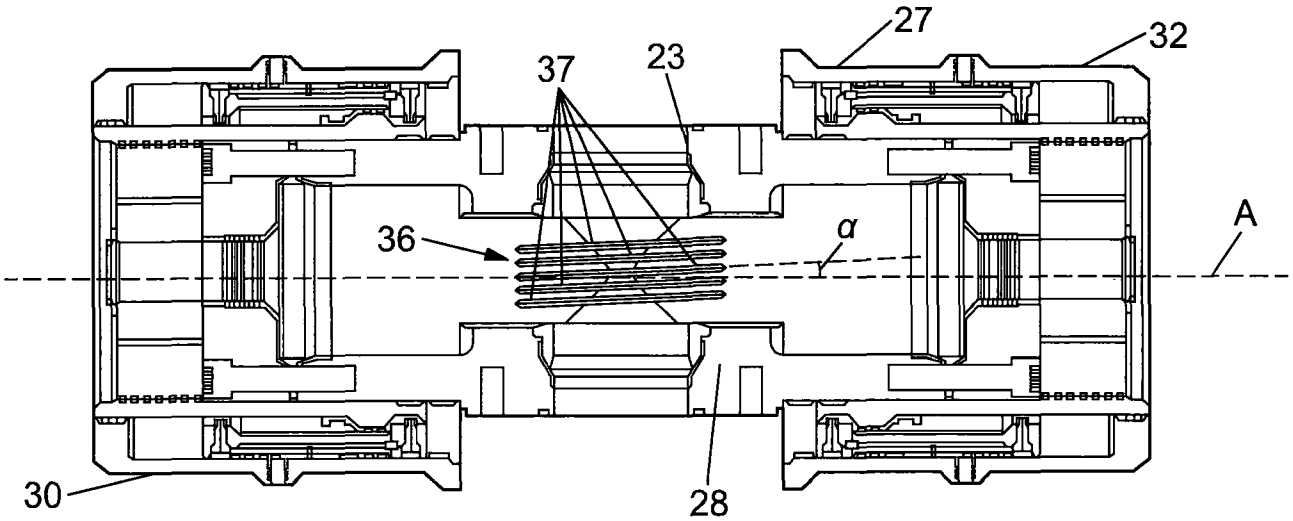
FIG. 3*a* is a vertical section view taken through the apparatus of FIG. 2 on lines 3-3 of FIG. 2 with shear rams and sealing gates removed.
Figure 3C:
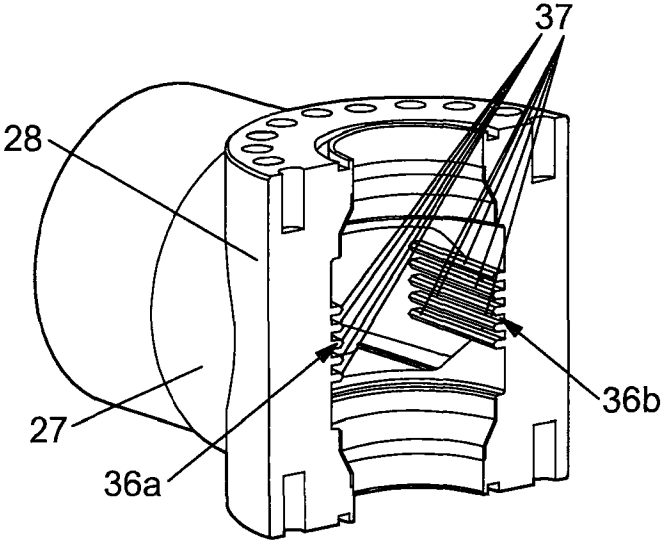
FIG. 3*c* is a vertical section view taken through the apparatus of FIG. 2 on the lines 4-4.
Figure 3B:
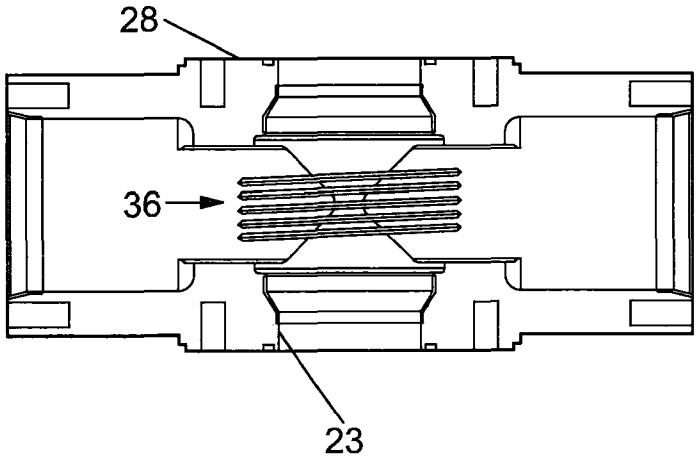
FIG. 3*b* is an enlarged view of part of FIG. 3*a;*

Referring to FIGS. 3*a* and 3*b*, which are vertical sections taken on lines 3-3 of FIG. 2 with shear rams and sealing gates removed. In this embodiment, the housing 27 includes a guide element 36, which consist of a plurality of parallel and elongated ribs 37. The guide element 36 is adapted to interact with the lower and/or upper gate 64*a*,64*b* and defines a path for the upper and/or lower gate to be moved on. It will be appreciated that in further embodiments, only one rib 37 may be provided in the housing 27. It will be further appreciated that the in further embodiment, the guide element 36 may include one or more recesses and/or grooves.

As can be seen in FIGS. 3*a* and 3*b*, the ribs 37 are arranged in the housing 27 in a substantially transverse direction to the throughbore 23. Here, the ribs 37 are inclined with respect to a longitudinal axis A of the housing 27. The ribs 37 are arranged within the housing 27 to define an acute angle $\alpha$ to the longitudinal axis A of the housing 27. The angle $\alpha$ of the ribs 37 shown in FIG. 3*a* is not to scale and exaggerated for illustrative purposes. Here, the ribs 37 are part of the main body 28, extending substantially transverse to the through bore. For friction lock coefficient of friction $(\mu)>\sin(\alpha)$. For no friction lock $\mu<\sin(\alpha)$.

Referring to FIG. 3*c*, this figure shows a vertical section taken on the line 4-4 of FIG. 2. The housing 27 has first and second guide elements 36*a* and 36*b*. Both the first and second guide elements 36*a* and 36*b* have a plurality of ribs 37. It will be appreciated that in further embodiments, the housing may include more or less than two guide elements 37. Here, the first and second guide elements 36*a* and 36*a* are provided in the housing 27 so as to oppose one another, e.g. the first and second guide elements 36*a* and 36*b* are provided on two opposing surfaces of the bore 23 within the main body 28.

Figure 4:
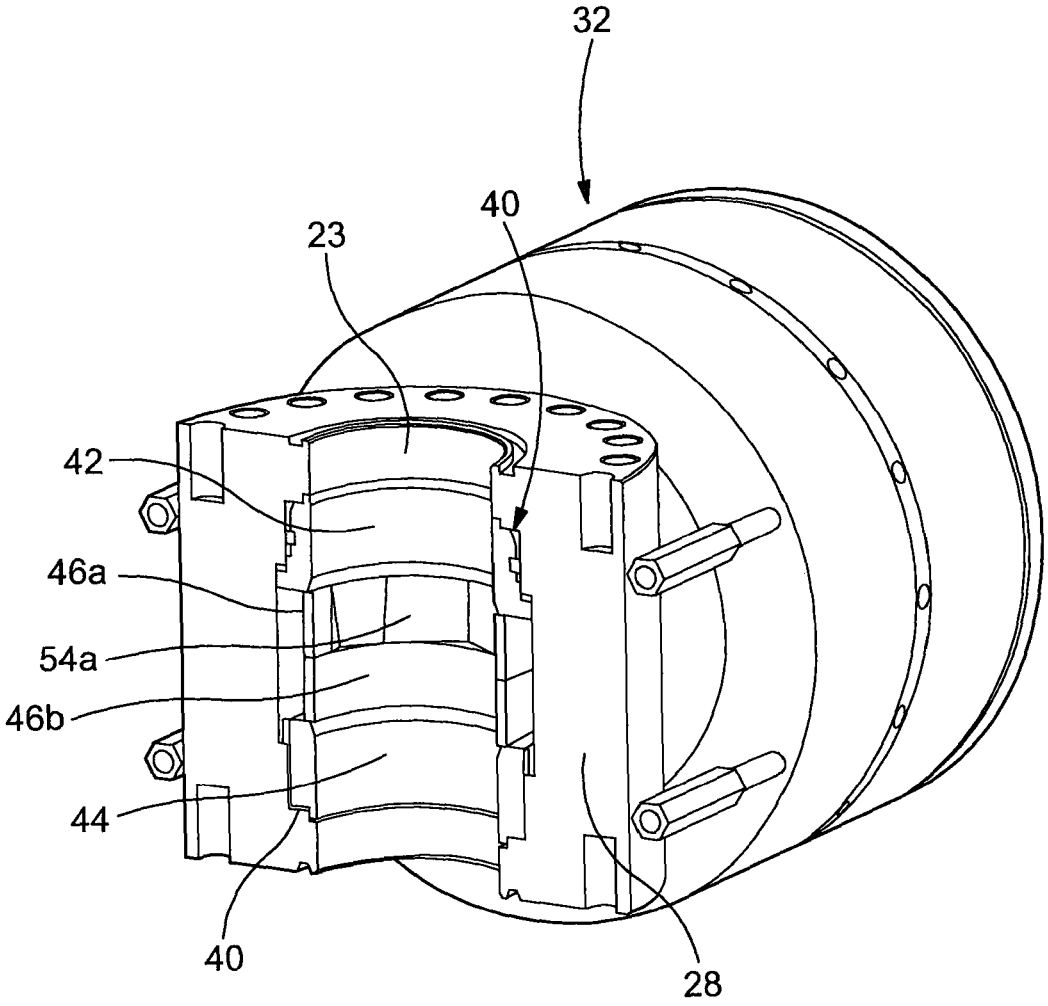
FIG. 4 is a cross sectional view taken through the apparatus shown in FIG. 2 on the lines 4-4.

Reference is now made to FIG. 4 of the drawings which is a vertical section taken on the lines 4-4 of FIG. 2. It will be seen that the main body 28 defines the bore 23 and the main body has an internal bore profile 40 into which are disposed upper metal valve seal 42 and lower metal valve seal 44. Between the seals 42, 44 are shown parts of shear rams, the parts being upper and lower travelling block portions 46*a* and 46*b* respectively, which are coupled to ram drive rods and sealing gates, as will be later described in detail. The upper travelling block is shown coupled to cutting blade 54*a*. When the apparatus is actuated the shear rams move horizontally and traverse the well bore 23 and in combination with a similar blade (not shown) coupled to lower travelling block 46*b* shear any tubular passing through the well bore, as will be later described in detail.

Figure 5:
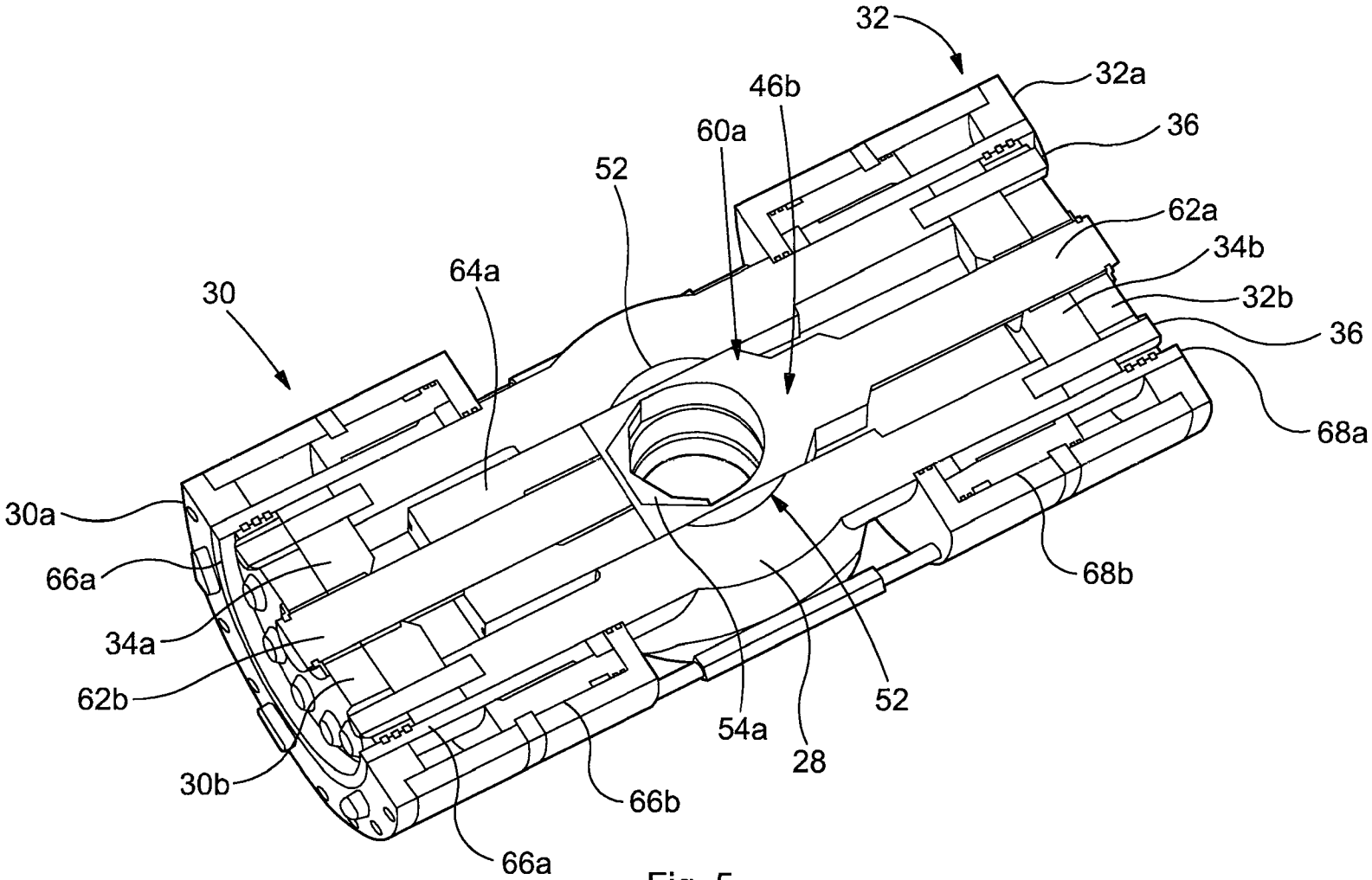
FIG. 5 is a cross sectional view through the device of FIG. 2 taken on the lines 3-3.

Reference is now made to FIG. 5 of the drawings, which is a horizontal sectional view through the apparatus shown in FIG. 2. It will be seen that the main body 28 has, at each respective cylindrical end 30 and 32, respective end caps 30*a*, 32*a* butt plates 30*b*, 32*b*. The end caps 30*a*, 32*a* are fastened to cylindrical ends 30, 32. The flanges 34*a*, 34*b* are fastened to the main body 28 by super nuts and studs 36 and the butt plates 30*b*, 32*b* are fastened to inner hollow pistons 66*a*, 68*a* as will be later described. The main body structure and end plate structure define approximately the external length of the apparatus shown in the closed position.

The flanges 34*a*, 34*b* and main body 28 define an interior chamber generally indicated by reference numeral 52 into which are disposed the shear rams generally indicated by reference numerals 60*a* and 60*b*. The combination of butt plates and flanges are end covers.

Each shear ram 60*a*, 60*b* has a rod portion 62*a*, 62*b*, a travelling block portions 46*a*, 46*b* and gates 64*a* and 64*b* for sealing the well bore 23 when the apparatus is actuated, as will be later described in detail. Also shown in FIG. 5 is top cutting blade 54*a* which is generally V shaped in plan view and which has a hardened cutting edge made of Inconel or similar very hard material suitable for cutting through steel tubulars, cables, wires and the like.

Each cylindrical end 30, 32 also houses a hollow moveable inner pistons generally indicated by reference numeral 66*a*, 68*a* which are coupled to the respective movable outer pistons 66*b* and 68*b*. It will also be seen from FIG. 5 that butt plates 30*b* and 32*b* are coupled to respective inner pistons 66*a*, 68*a* and butt plates and are also coupled to shear ram rods 62*a* and 62*b* so that, as will later be described in detail, when the inner and outer pistons are actuated to move between an open and closed position, the piston rods and travelling blocks and cutting gates are moved between the open and the closed position.

Figure 6:
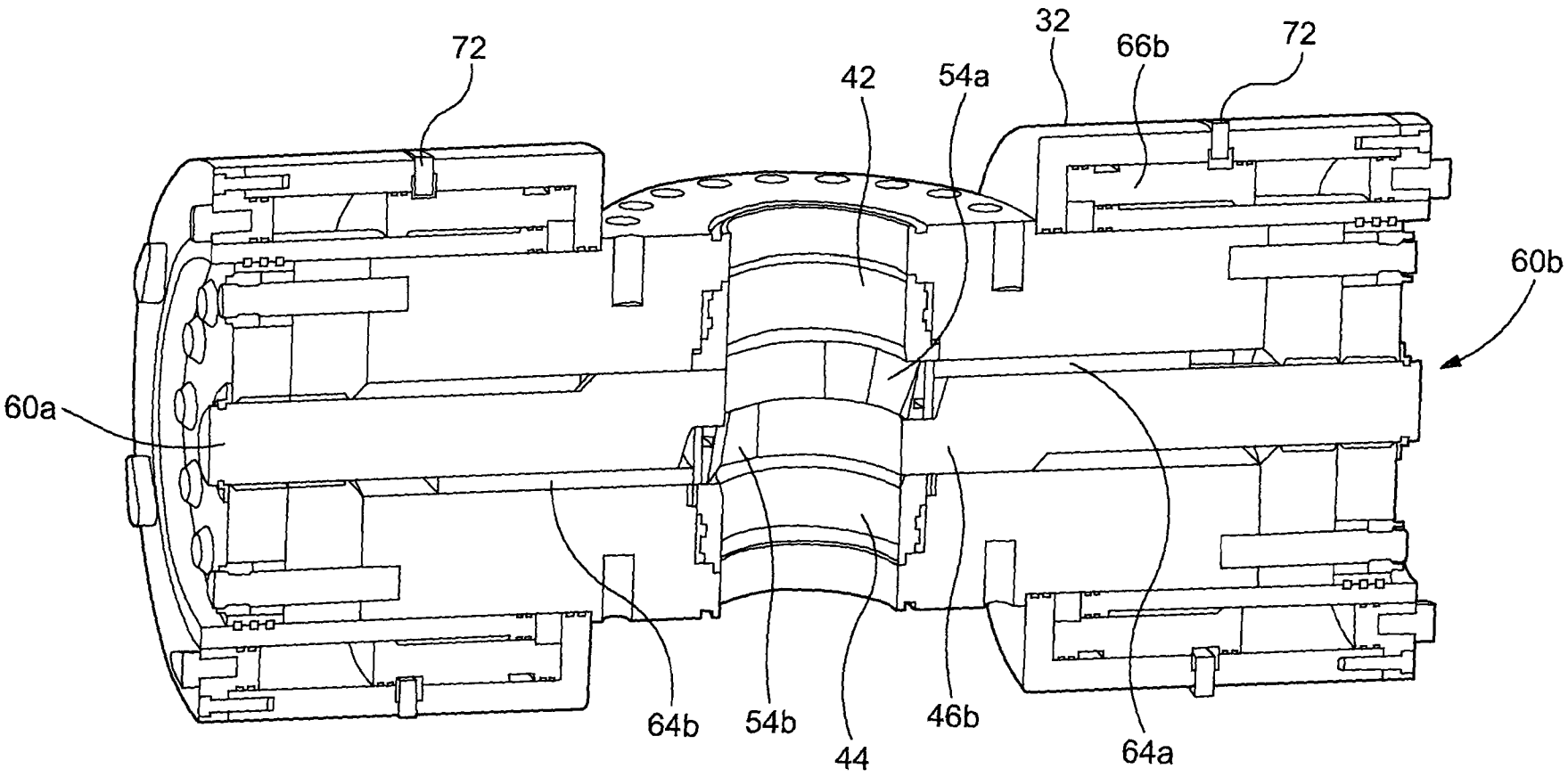
FIG. 6 is a vertical section view taken through the device of FIG. 2 on the lines 5-5.

FIG. 6 depicts a vertical sectional view through the apparatus of FIG. 2 and in this diagram upper and lower cutting blades 54*a* and 54*b* are shown coupled to the respective rams 60*a* and 60*b*.

Figures 7A, 7B:
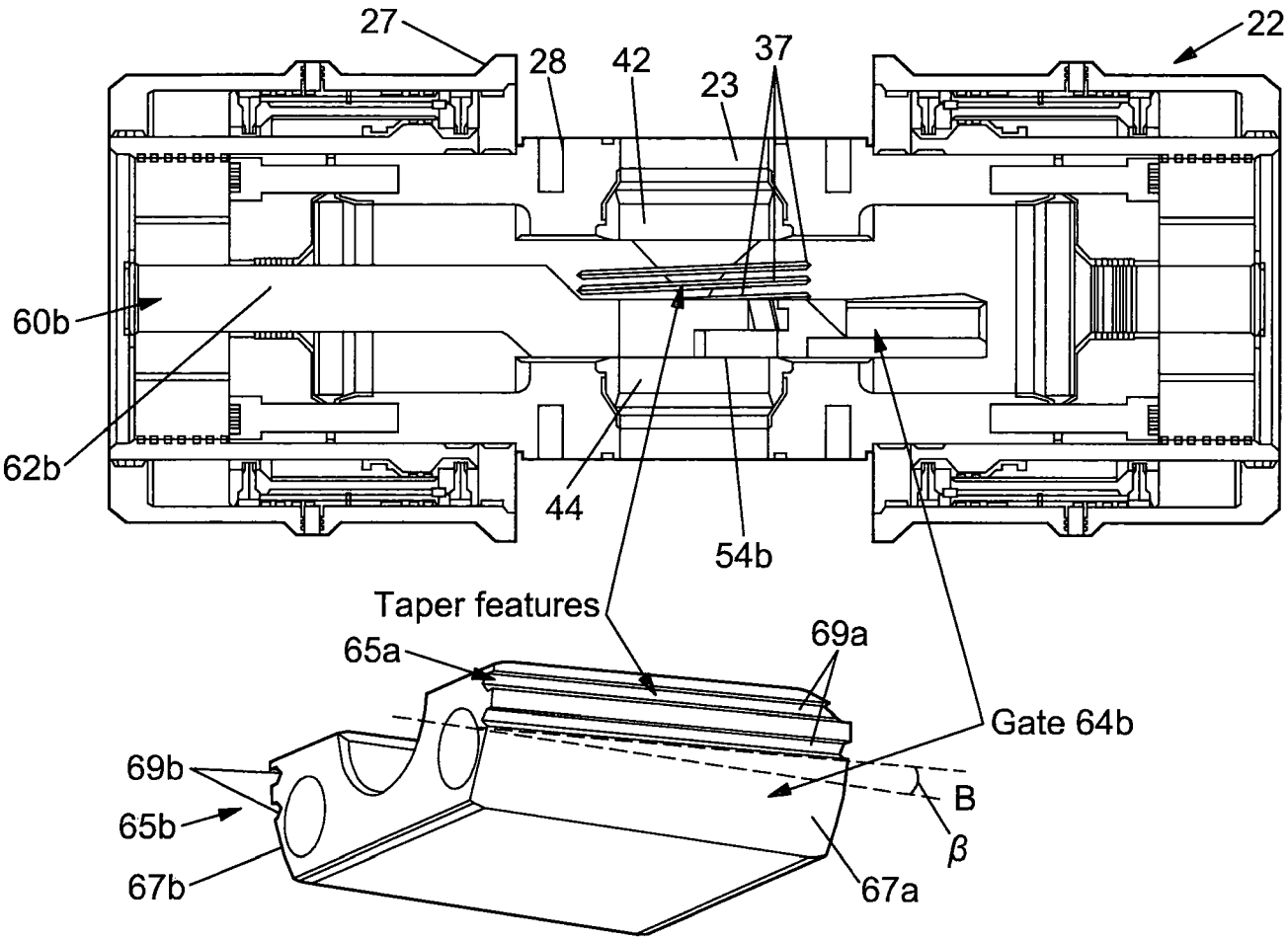
FIG. 7*a* is a vertical section view similar to FIG. 3*a*, illustrating a the lower shear ram and gate, having a cutting blade, of the apparatus of FIG. 1 in the open position.
FIG. 7*b* is enlarged isometric view of the lower gate of FIG. 7*a;*

Referring to FIGS. 7*a* and 7*b*, there is shown a further vertical view through the apparatus 22 of FIG. 2 and in these figures the lower shear ram 60*b* and lower gate 64*b* with lower cutting blade 54*b* are in the open position.

As can be seen in FIG. 7*b*, the lower gate 64*b* has first and second engagement elements 65*a* and 65*b*, which are arranged on outer opposing surfaces 67*a* and 67*b* of the lower gates 64*b* for mating, interoperating and/or co-acting with the ribs 37 of the first and second guide elements 36*a* and 36*b* of the housing 27. In FIG. 7*b*, the lower gate 64*b* has two recesses 69 provided on outer surfaces 67*a* and 67*b*, which can engage with ribs 37 of the housing 27. It will be appreciated that in further embodiments the lower gate 64*b* may comprise a single ribs, recess and/or groove or a plurality of ribs, recesses and/or grooves for engagement with a respective single rib, recess and/or groove or a respective plurality of ribs, recesses and/or grooves of the guide element 37.

Referring to FIG. 7*b*, the recesses 69*a*, 69*b* are arranged on the lower gate 64*b* along a length or in a longitudinal direction of the lower gate 64*b*. The recesses 69*a*,69*b* are inclined with respect to a longitudinal axis B of the lower gate 64*b* and arranged on the lower gate 64*b* to define an acute angle β to the longitudinal axis B of the lower gate 64*b*, as illustrated in FIG. 7*b*. The angle β shown in FIG. 7*b* is not to scale and exaggerated for illustrative purposes. In some embodiments, the acute angle β defined by the recesses 69*a*,69*b* is the same as the acute angle α defined by the ribs 37.

It will be appreciated that further embodiments, the acute angle β may differ from the acute angle α but it will be understood that the recesses 69*a*, 69*b* define a groove 69*c* which has a sufficient spacing to accept a rib 37.

As can be seen in FIG. 7*b*, the lower gate 64*b* has a taper along a length of the lower gate 64*b*. As will be further described below, the taper allows for the upper and lower gates 64*a*, 64*b* to co-act with each other when the upper and lower gates 64*a*,64*b* gates are open, closing or in the closed position. It will be appreciated that the features of the lower gate 64*b*, described above with reference to FIG. 7*b*, are equally applicable to the upper gate 64*a*.

Figure 8A:
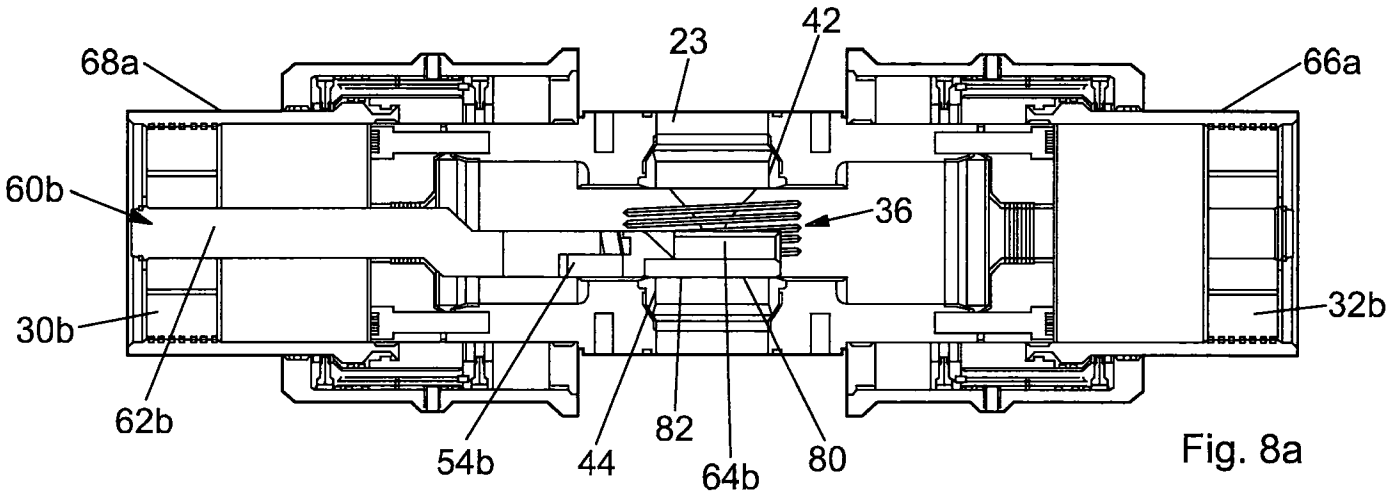
FIGS. 8*a* and 8*b* are vertical section views similar to FIG. 7*a*, showing the lower gate being actuated by a guide element to seal a well bore in the closed position of the apparatus of FIG. 1.
Figure 8B:
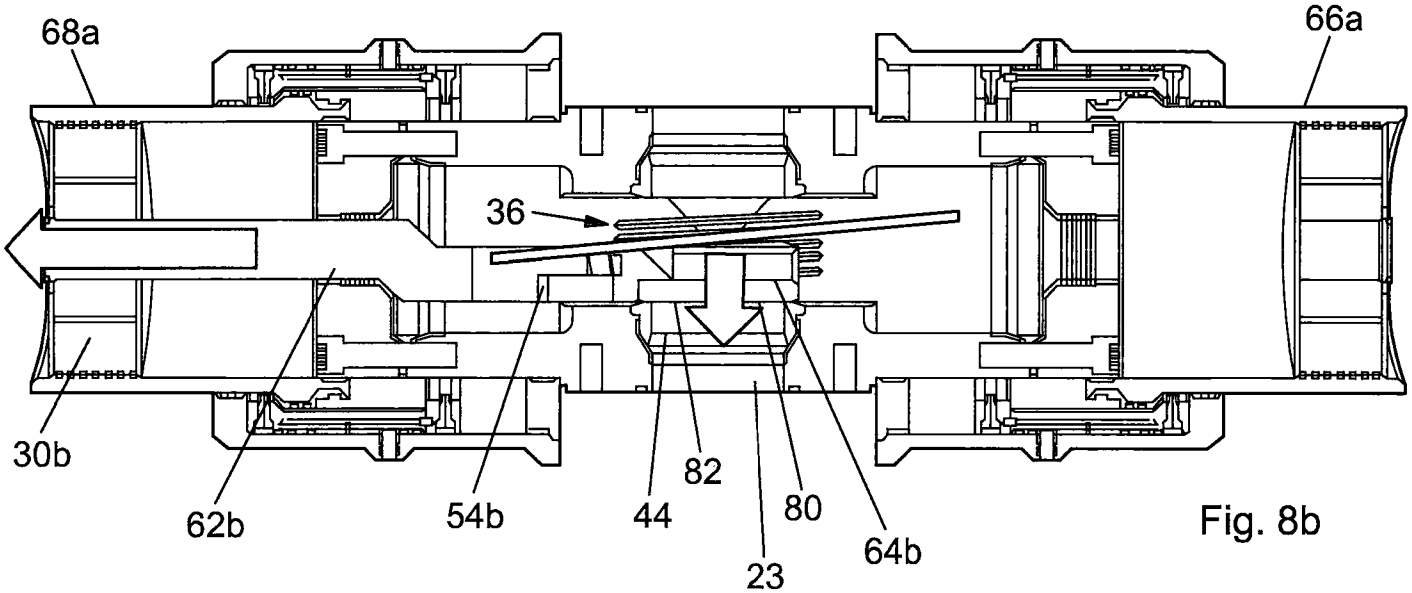

FIGS. 8*a* and 8*b* show the lower gate 64*b* of FIG. 7*b* in the closed position of the bore 23. FIGS. 8*a* and 8*b* show the apparatus 22 actuated such that the hollow inner pistons 66*a*, 68*a* are moved outwardly and pull butt plates 30*b* and 32*b* and shear rams 60*a* (not shown) and 60*b* coupled thereto so that the cutting blades 54*a* (not shown), 54*b* cut the tubular (not shown). At the extent of travel shown in FIGS. 8*a* and 8*b* the lower gate 64*b* is shown sealing the bore 23. It will be seen that the lower surface 80 of gate 64*b* is shown abutting the upper surface 82 of valve seal 44 thus providing metal to metal sealing between the lower gate 64*b* and the valve seal 44 to provide an effective metal to metal seal.

As illustrated in FIG. 8*b* the ribs 37 of the guide element 36 are arranged to guide the lower gate 64*b* into sealing engagement with the lower valve seal 44. When the lower gate 64*b* moves from the open position to the closed position the ribs 37 vertically displace the lower gate 64*b*. The ribs 37 create or provide a displacement component of the movement of the gate lower 64*b*, which is perpendicular to the direction of actuation and parallel to the bore 23, as indicated by the arrows in FIG. 8*b*. The vertical displacement of the lower gate 64*b*, creates a deflection of material within the adjacent valve seal 44, thereby energising the metal to metal valve seal against surface 80 of the lower gate 64*b*. By vertically displacing the lower gate 64*b* into sealing engagement with the lower valve seal 44, a substantially fluid tight seal is formed between the lower gate 64*b* and the valve seal 44, which is substantially independent of any wellbore fluids and/or pressure. This arrangement provides a fluid tight metal to metal seal, which results in a more robust and enhanced seal integrity in well bores. If the angle α is sufficiently acute, friction between the seat and gate and gate and rib will be limiting and the gate will experience zero backlash. The gate can/will be effectively locked by friction alone.

In the closed position, the engagement elements 65*a*, 65*b* of the lower gate 64*b* engage or abut the ribs 37 of guide element 36 and the main body 28 to form a further seal, which is a metal to metal seal, between the lower gate 64*b* and the guide element 36 and the main body 28.

As can be seen in FIGS. 8*a* and 8*b*, by arranging the guide element 36 to actuate the lower and/or upper gate 64*a*, 64*b* into sealing engagement with the respective upper and/or lower valve seal 42,44, the bore 23 is sealed when either the upper or the lower gate 64*a*,64*b* is in the closed position. The guide element 36 can actuate the lower and upper gates 64*a*,64*b* so that the upper and lower gates 64*a*, 64*b* provide the upper and lower seals independently from each other in the closed position. This arrangement provides a failsafe well bore control apparatus 22. It will be appreciated that the features of the lower gate 64*b*, described above with reference to FIGS. 8*a* and 8*b*, equally applicable to the upper gate 64*a*.

Figure 9A:
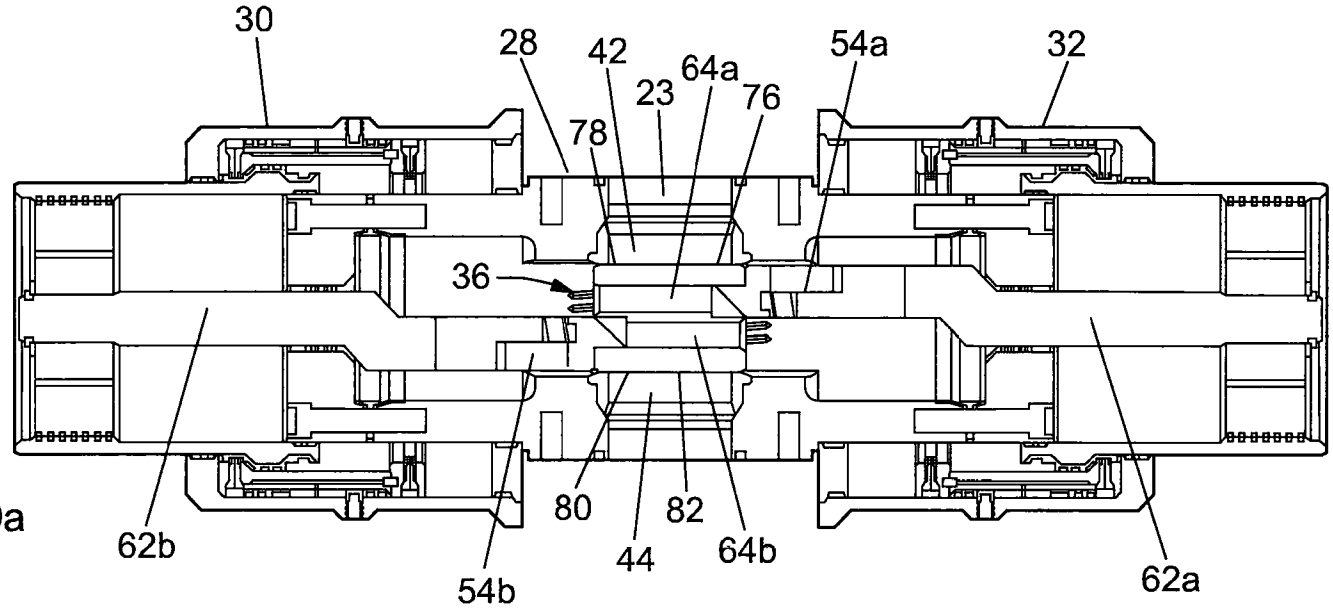
FIG. 9*a* is a vertical section view similar to FIG. 8*a*, showing the upper and lower gates being actuated by the guide element to seal the well bore in the closed position of the apparatus of FIG. 1.
Figure 9B:
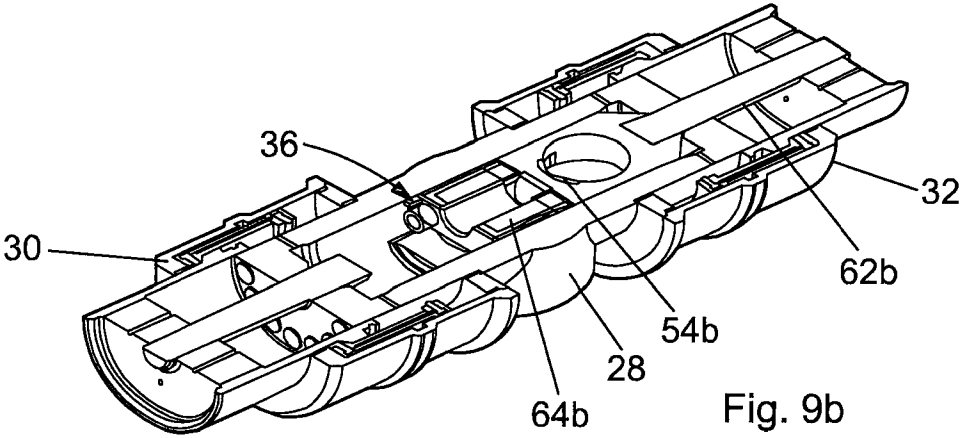
FIG. 9*b* is a cross sectional view similar to FIG. 5 in the closed position of the apparatus of FIG. 1.

Referring to FIG. 9*a*, there is shown the upper and lower gates 64*a*, 64*b* in the closed position, thereby sealing the bore 23. FIG. 9*b* of the drawings, which is a horizontal sectional view through the apparatus shown in FIG. 2 with the lower gate 64*b* in the closed position. Although the above formation of the lower seal and further seal has been described with respect to the lower gate 64*b* in FIGS. 8*a* and 8*b*, it will be appreciated that the upper gate 64*a* may form an upper seal with the upper valve seal 42 in the same manner as described above in relation to the lower gate 64*b*. Similarly, it will appreciated that both the lower and upper gate 64*a*, 64*b* can sealingly engage the upper and lower seal seats 42,44 as shown in FIG. 9*a*. At the extent of travel shown in FIG. 9*a* the gates 64*a*, 64*b* are shown sealing the bore 23. It will be seen that an upper surface 76 of gate 64*a* abuts a lower surface 78 of valve seal 42 and similarly the lower surface 80 of gate 64*b* is shown abutting an upper surface 82 of valve seal 44 thus providing metal to metal sealing between the gate and the seals to provide an effective metal to metal seal in two positions within the apparatus.

Figure 10:
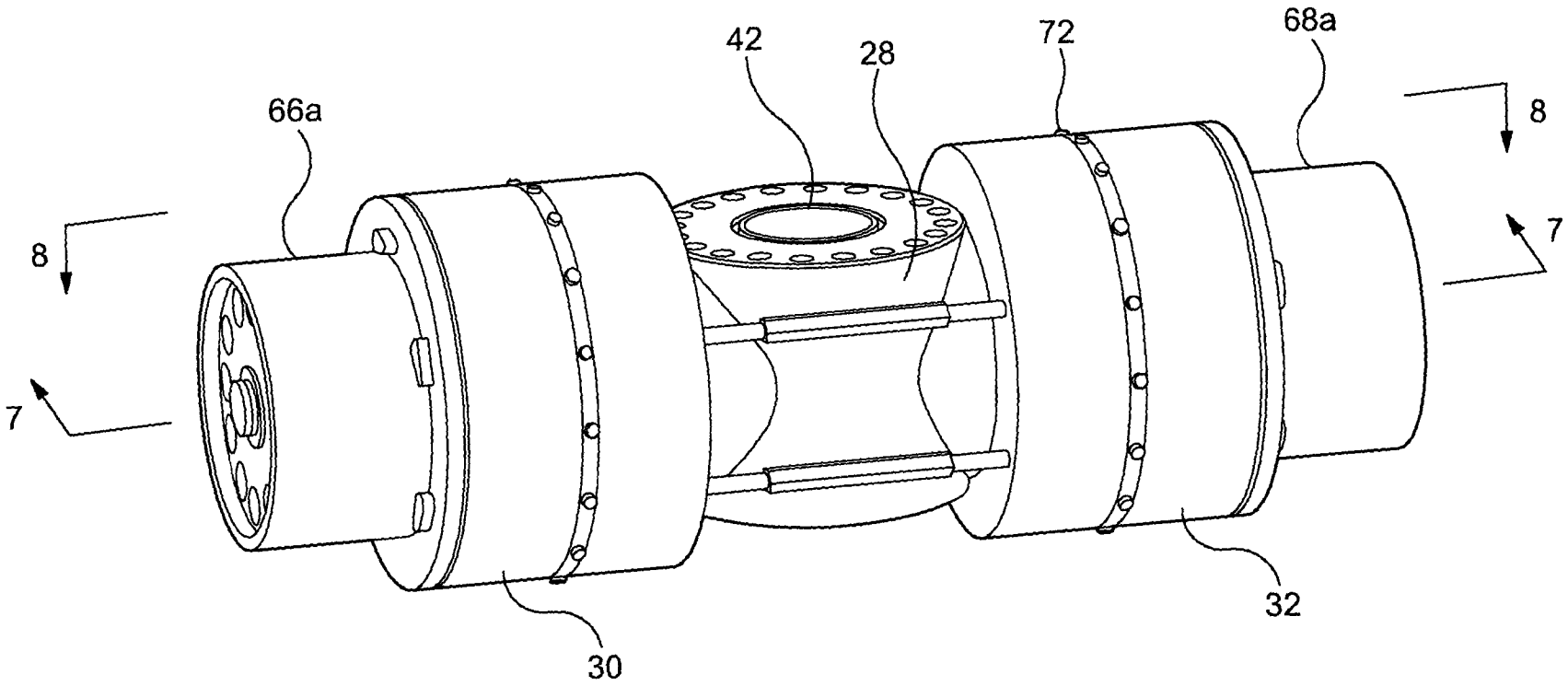
FIG. 10 depicts the well bore control apparatus of FIG. 2 but with the actuators moved so that the device is in the closed position to seal the well bore.
Figure 11:
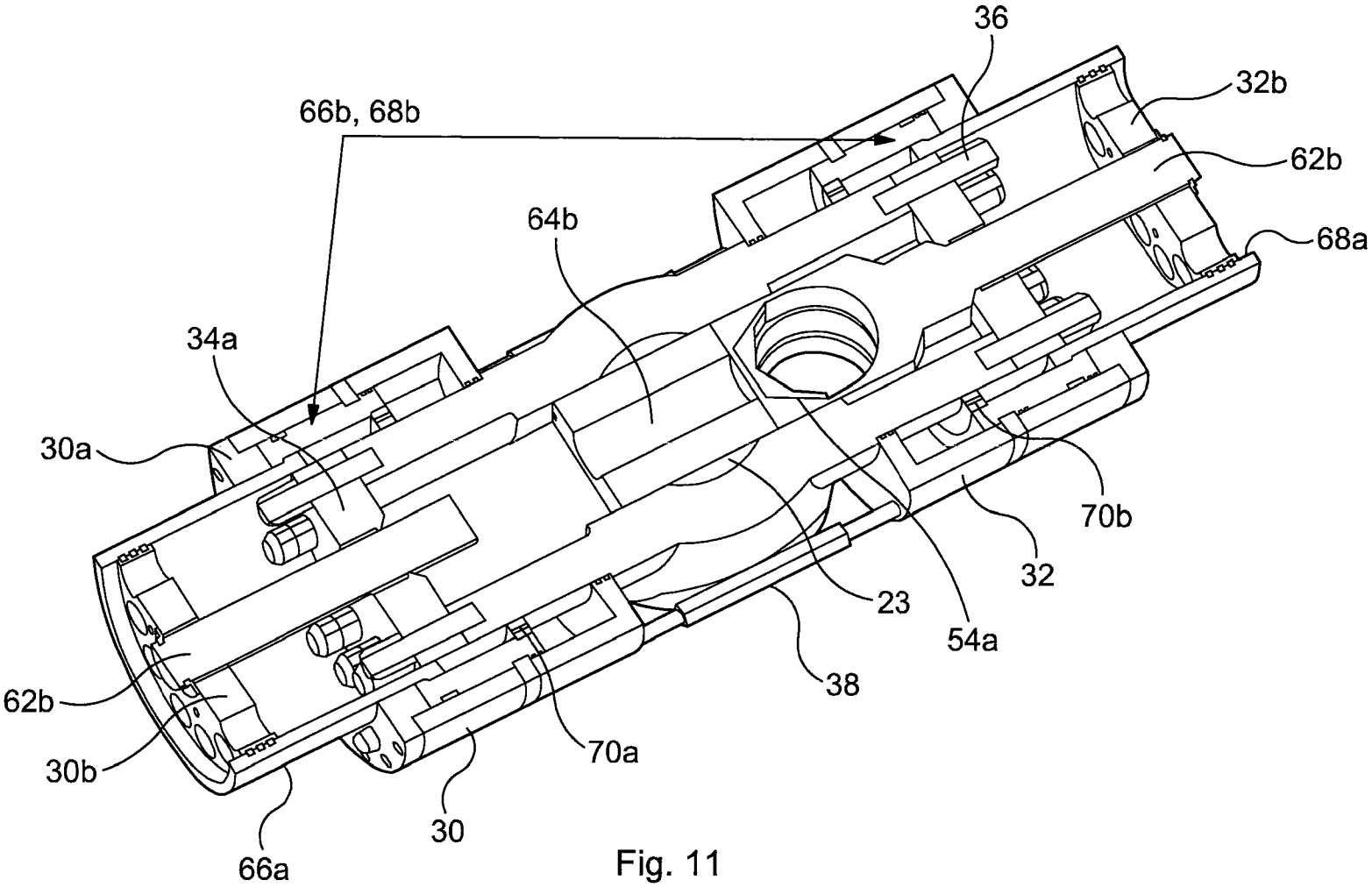
FIG. 11 is a cross sectional view similar to FIG. 9*b* but with no guide element present according to an embodiment of the present invention.
Figure 12:
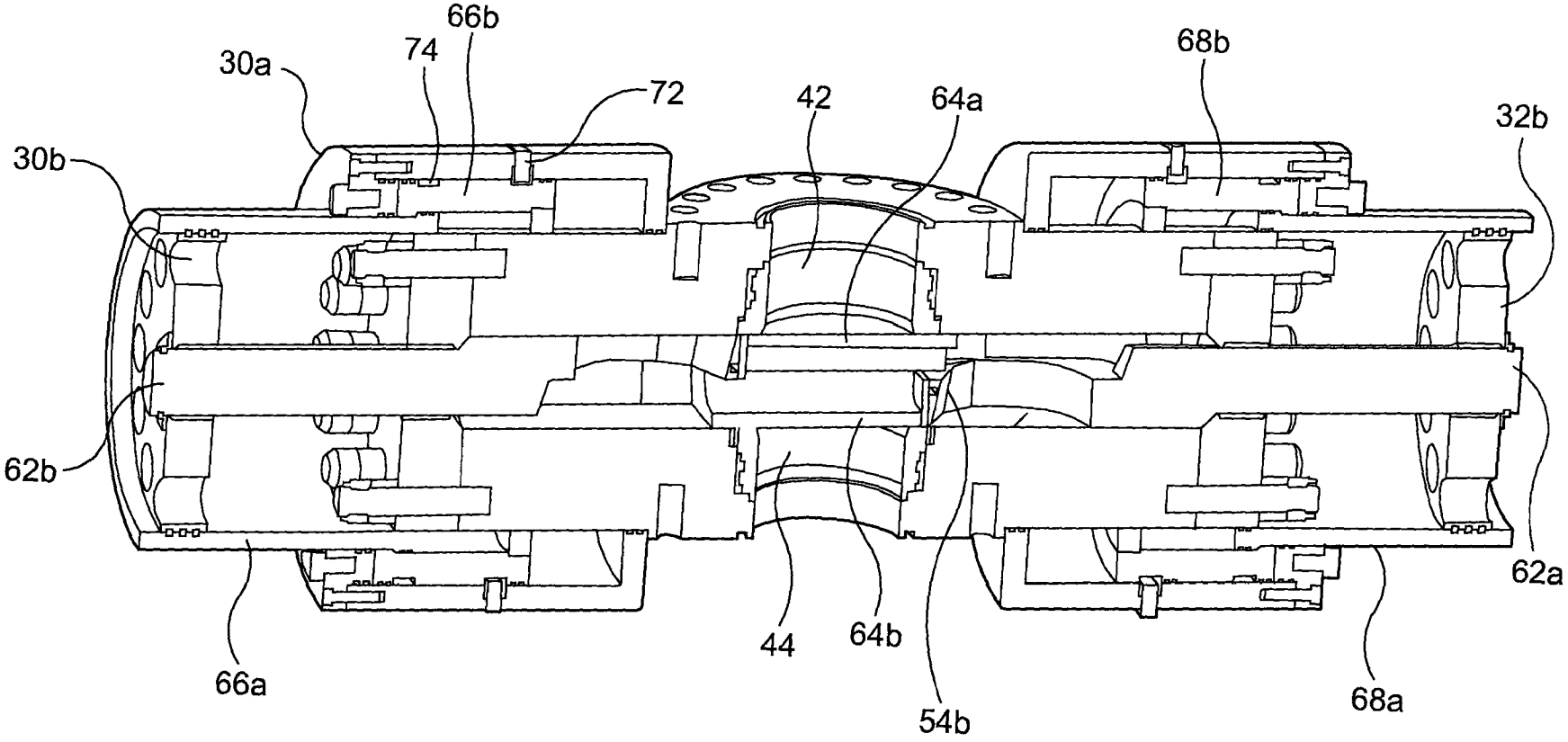
FIG. 12 is a similar vertical sectional view of FIG. 9*a* but with no guide element present according to an embodiment of the present invention.

Reference is now made to FIGS. 9*a* and 9*b*, 10, 11 and 12 of the drawings which depict the well bore control apparatus in the closed position. Referring first to FIG. 10 it will be seen that the pistons have been hydraulically actuated to move the gates 64*a*, 64*b* to a closed position such that the inner pistons 66*a*, 68*a* are shown displaced to a position where they extend from the bore 23 beyond their respective housing cylinders 30 and 32. Internally this is best illustrated by reference to FIGS. 9, 11 and 12 which are respective horizontal and vertical sectional views similar to FIGS. 5 and 6 respectively. Referring first to FIG. 11, it will be seen that the outer pistons have been actuated and moved within the respective cylindrical housings to the positions shown and, as such, as they are coupled to inner pistons 66*a*, 68*a*, these pistons are moved away from the well bore. However, the butt plates 30*b*, 32*b* are coupled to the shear ram actuation rods 62*a*, 62*b* and these are pulled in the same direction as the pistons 66*a*, 68*a* such that the shear rams 60*a*, 60*b* are displaced or pulled outwardly in the opposite direction to the position shown in FIG. 11. In this case, the gates 64*a*, 64*b* are displaced over the well bore 23. It will be understood that, should a tubular have been present within the well bore, the tubular would have been first sheared by the blades 54*a*, 54*b* to allow the gates 64*a*, 64*b* to cover and seal the well bore as shown in FIGS. 11 and 12. Within each cylindrical housing 30 and 32 respective stop rings 70*a*, 70*b* are located which limit the extent of travel of the outer and inner pistons thereby adjusting the exact positioning of the gates to seal the well bore.

As will be later described in detail, when the piston is either in the closed or the open position, it can be retained therein by using a plurality of locking dogs 72 which are shown disposed around the periphery of the cylinder. The locking dogs are spring loaded to be retained in recesses 74 in the outer surface of pistons 66*b*, 68*b*.

Figure 13:
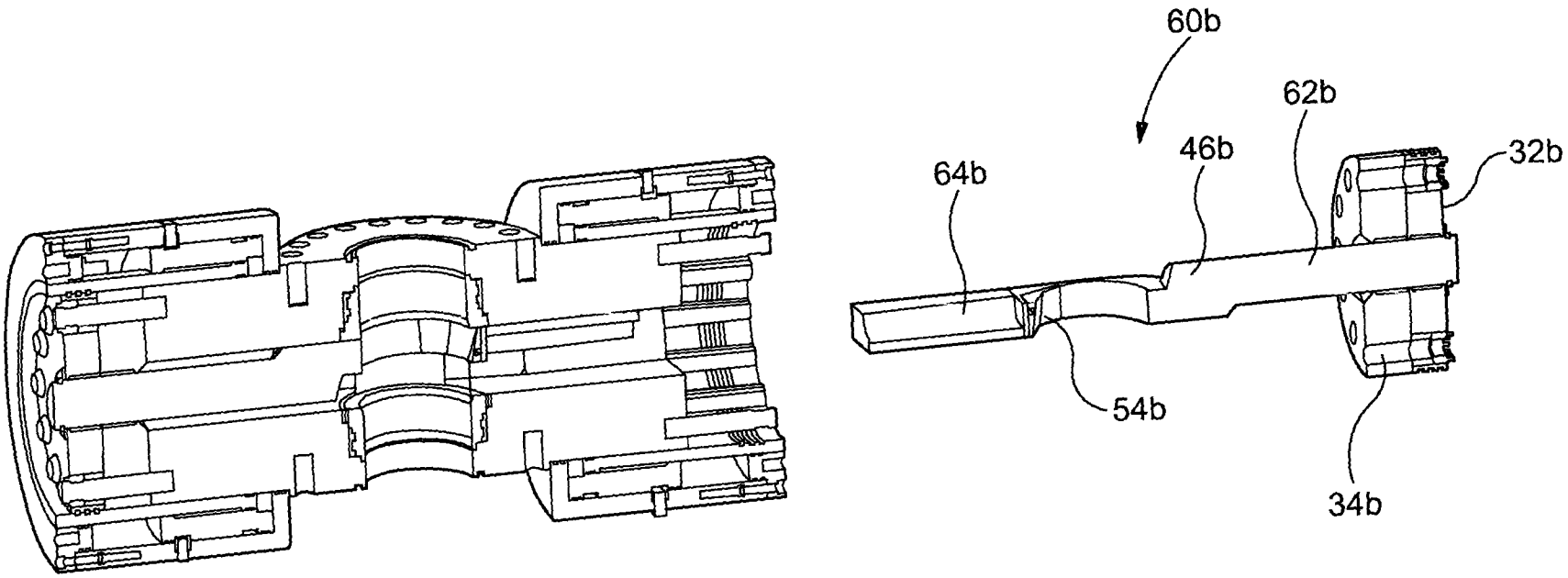
FIG. 13 is a view similar to FIG. 6 but with no guide element present and with an end butt plate and attached gate rod and sealing gate shown removed.

Reference is now made to FIG. 13 which depicts a vertical sectional view through the well bore control apparatus in a view similar to FIG. 6, but with the lower shear ram assemblies 60*b* shown removed. The lower shear ram assembly shown here consists of the butt plate 32*b*, the flange 34*a* and the shear ram consisting of the rod 62*b*, the travelling block 46*b*, the blade 54*b* and the gate 64*b*. Thus, it will be appreciated that by removing a shear ram in this way the internal structure of the apparatus can be serviced, maintained and for example the blades 54*a*, 54*b* can be replaced and the gates 64*a*, 64*b* can also be replaced and/or machined. Similarly, this allows access into the metal to metal seals 42, 44 which can also be removed and replaced by similar types of seals or seals of a different material thus facilitating servicing of the apparatus. FIGS. 11 to 13 shows an alternative embodiment of the well bore apparatus of FIGS. 1 to 10, with no guide element 36 present in the main body 28. It will be appreciated that in further embodiments, the well bore apparatus of FIGS. 11 to 13 may be provided with one or more guide elements, as described above.

Figure 14A:
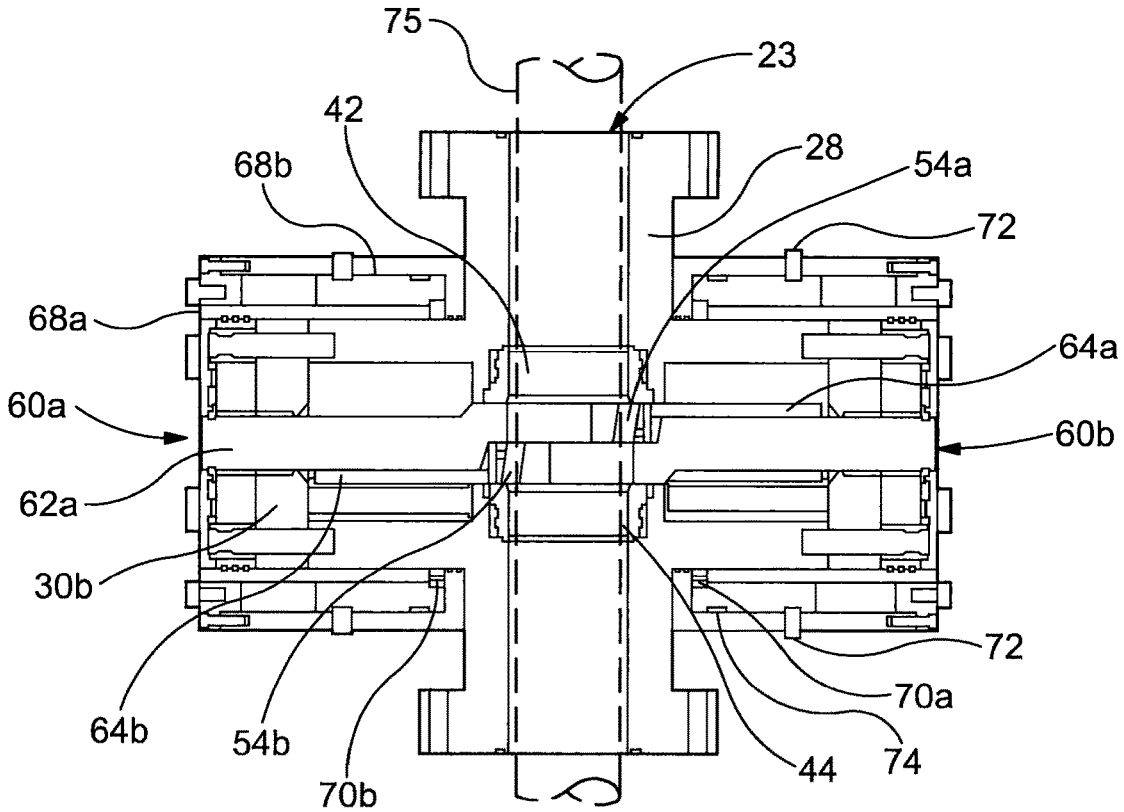
FIGS. 14*a* and 14*b* are vertical sectional views through the well bore control apparatus with the gates actuated in the open position as shown in FIG. 14*a* and in the closed position as shown in FIG. 14*b;*
Figure 14B:
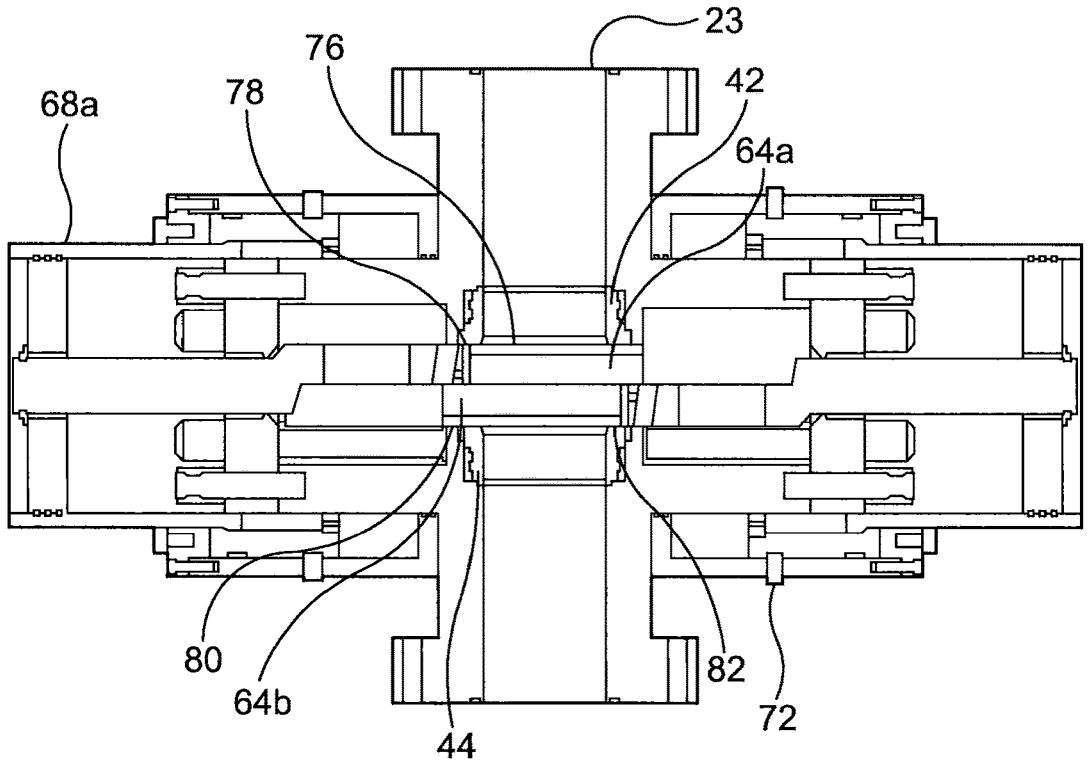

Reference is now made to FIGS. 14*a*, 14*b* and 15*a* and 15*b* of the drawings which better illustrate the operation of the apparatus in accordance with the invention. The apparatus in FIG. 14*a* is shown closed with the rams in a position such that the well bore 23 is open with a tubular 75 passing therethrough and shown in broken outline. FIG. 14*b* shows the apparatus actuated such that the hollow inner pistons 66*a*, 68*a* are moved outwardly and pull butt plates 30*b* and 32*b* and shear rams 60*a* and 60*b* coupled thereto so that the cutting blades 54*a*, 54*b* cut the tubular which is shown separated in broken outline 75. At the extent of travel shown in FIG. 14*b* the gates 64*a*, 64*b* are shown sealing the bore 23. It will be seen that the upper surface 76 of gate 64*a* abuts the lower surface 78 of seal 42 and similarly the lower surface 80 of gate 64*b* is shown abutting the upper surface 82 of seal 44 thus providing metal to metal sealing between the gate and the seals to provide an effective metal to metal seal in two positions within the apparatus similar to the arrangement disclosed in the aforementioned UK patent GB2454850B. It will also be understood that metal seals 42, 44 energises against housing 28 providing further metal to metal seals and avoiding the requirement for elastomeric seals.

Figures 15A, 15B:
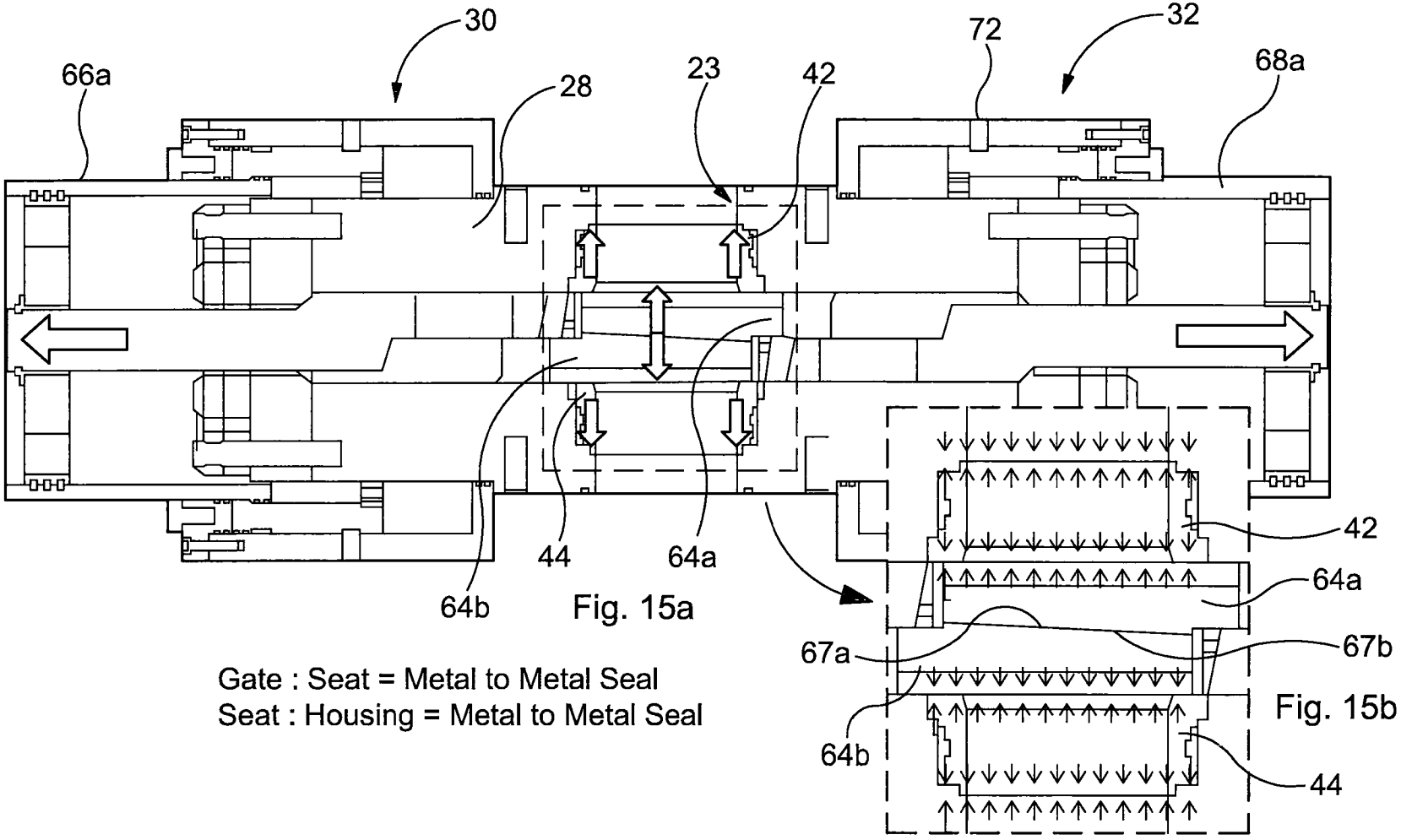
FIG. 15*a* is a vertical sectional and diagrammatic view similar to FIGS. 14*a* and 14*b* and showing diagrammatically tapered gates.
FIG. 15*b* is an enlarged detail of part of FIG. 15*a* shown in broken outline.

Reference is made to FIGS. 9, 15*a* and 15*b* where it will be seen that the gate blocks 64*a*, 64*b* are tapered along the direction of travel shown as exaggerated taper surfaces 67*a*, 67*b* such that as the gate blocks move the tapers pass over each other to create a displacement component of motion which is perpendicular to the direction of actuation and parallel to the housing throughbore. This perpendicular component, shown in blue arrows in FIGS. 15*a* and 15*b* is axial and is sufficient to create a deflection of material within the adjacent valve seats 42, 44 thus energising the metal to metal valve seat seal against the surfaces 76, 80 of the respective gates 64*a* and 64*b* and it also energises the seals 42, 44 against housing 28 providing further metal to metal seals. The angle of taper illustrated in FIGS. 15*a* and 15*b* is shown not to scale. It is preferable that a shallow angle is used in order to generate the required preload to energise the metal to metal seals and to minimise the depth of the galley.

The minimum angle of the taper that can be utilised is limited by the preload capacity of the seal arrangement and/or the stroke length of the actuator.

The maximum angle of the taper that can be utilised is limited by the preload requirements of the seal and/or the capacity of the actuator and/or the capacity of the actuator locks.

A shallow angle is preferred in order maximise the transfer of work done by the actuator to seal preload, but the angle must sufficient to be compliant with the system in terms of its manufacturing and assembly tolerances.

The angle of taper may be so shallow such that it is difficult to perceive by eye, but the gates will have sufficient tapers to generate an intended component of displacement perpendicular to the direction of travel of the gates sufficient to energies a seal.

This has a significant advantage that once the valve is closed, the seal is already fully energised independent of any well bore pressure or fluid excitement, providing an extremely robust seal for both low pressure fluids and low density fluids. This arrangement places all seal locations of the bore in a state of high compressive pre load irrespective of the state of bore conditions or conditions of any fluid within the bore. This provides a true self energising bi-directional metal to metal seal and the seal state of high compressive pre load allows for the use of full metal to metal seal thus providing a more robust and enduring seal integrity.

Figure 16:
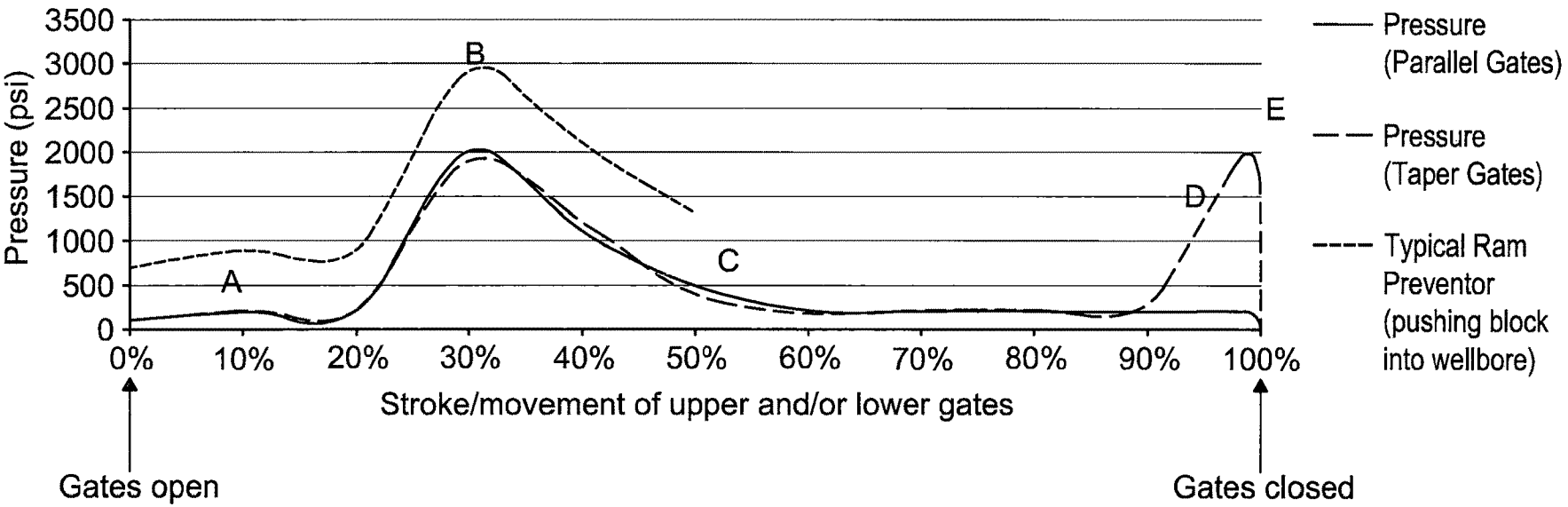
FIG. 16 shows a graph of the relationship of pressure applied to the actuators during movement of the gates for a well bore apparatus having parallel and tapered gates according to embodiments of the invention and for a well-bore apparatus with rams that are pushed together.

FIG. 16 shows a graph of the relationship of pressure or hydraulic pressure applied to the actuators, for example the inner and outer pistons 66*a*,66*b*,68*a* 68*b*, during the movement of the upper and lower gates 64*a*, 64*b* from the open to the closed position of the bore 23 for different configurations of the upper and lower gates in a wellbore control apparatus. The solid line in FIG. 16 relates to a well bore control apparatus 22 with parallel gates, i.e. gates without a taper. The dashed line in FIG. 16 illustrates a well bore control apparatus 22 with tapered gates. The dotted line refers to a wellbore control apparatus with rams, which are pushed to one another to close the throughbore.

Referring to FIG. 16, it can be seen that at about 10 percent (A) of the movement, pressure is increased to the actuators to move the gates into the bore from the closed position. For ram preventors, this initial pressure is higher as a pressure of the bore pressure has to be overcome to push the gates into the bore.

Between 20 and 30 percent of the movement (B) the actuator pressure increases while the tubular contained in the bore 23 is cut by cutting blades 64*a*, 64*b*. For the well bore control apparatus with rams, the movement terminates at about 50 percent (C) as the rams only travel to a midpoint of the bore 23. For the embodiment of a well bore control apparatus with tapered gates and parallel gates (solid and dashed lines, respectively), the gate movement continues. At above 90 percent (D), the actuating pressure increases for the embodiment of a well bore apparatus with tapered gates. This increase is due to the interaction of the upper and lower gates, e.g. when the upper and lower gates 64*a*,64*b* slide over each other. Alternatively or additionally, this increase in actuating pressure can be due to the interaction of the guide element 37 with the engagement elements 65*a*,65*b* of the upper and/or lower gate 64*a*,64*b*.

In the embodiment of a well bore control apparatus with parallel gates, the seal provided by the upper and lower gates of the bore depends on wellbore pressure or fluid excitement. By providing a wellbore control apparatus with tapered gates, the seal of the bore is energised by the interaction and friction between the upper and lower seals 64*a*, 64*b*, as described above. The use of tapered gates may minimise the occurrence of leaks of wellbore fluids in the wellbore control apparatus and thus, lead to enhanced safety. Alternatively or additionally, by providing a well bore apparatus with a guide element, the seal of the bore is energised actuating the gates, e.g. tapered or parallel gates, into sealing engagement with the upper and/or lower valve seat 42,44, as described above.

Figures 17A, 17B:
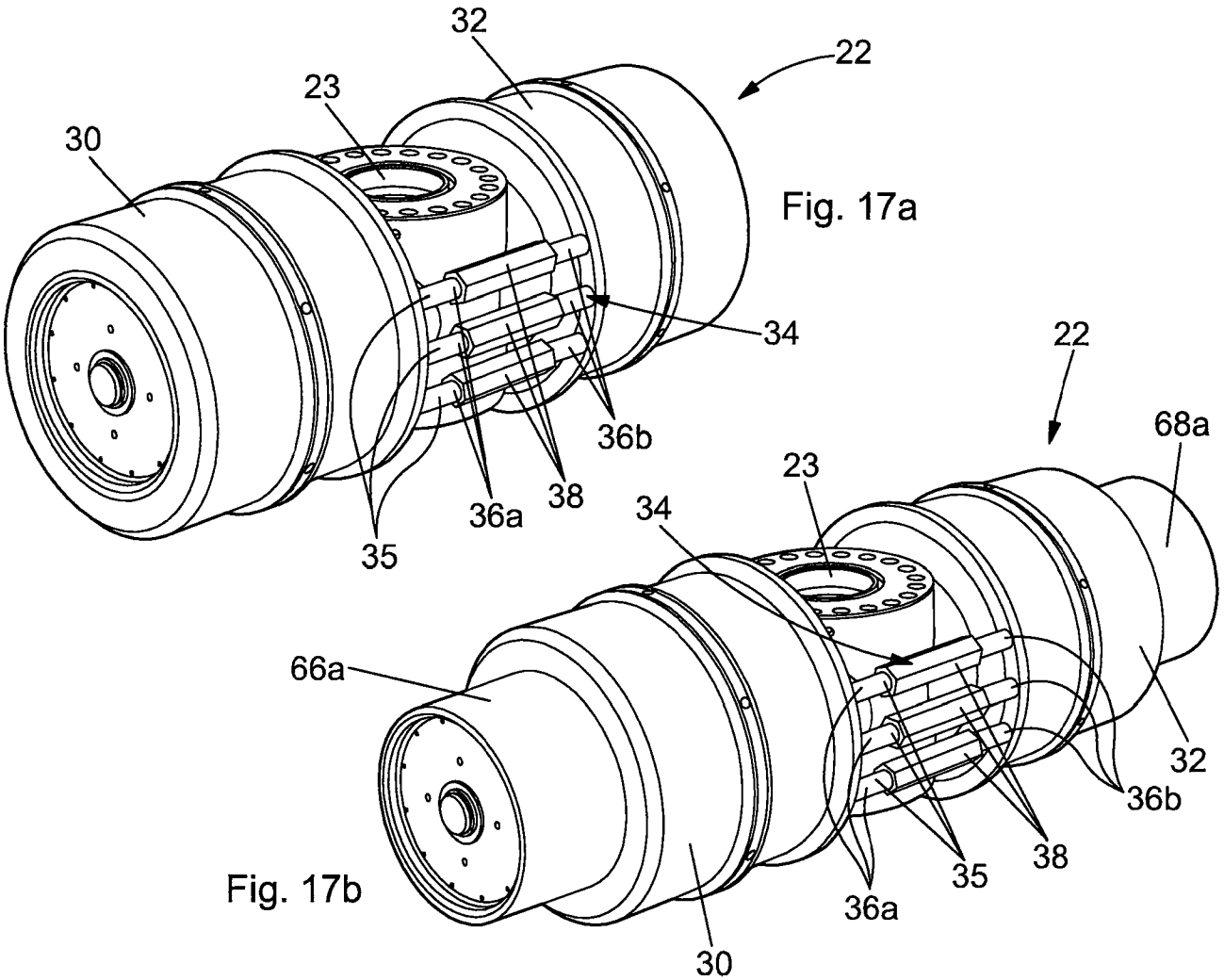
FIGS. 17*a* and 17*b* are views similar to FIG. 2, depicting coupling arrangement of the well bore apparatus, with the well bore apparatus being in the open position as shown in FIG. 17*a* and in the closed position as shown in FIG. 17*b*.

Referring to FIGS. 17*a* and 17*b*, there is shown enlarged views of the apparatus of FIG. 1 in the open position (FIG. 17*a*) and in the closed position of the bore 23 (FIG. 17*b*). As described with reference to FIG. 2, first and second actuator housings 30 and 32 are fastened together by the coupling arrangement 34. Each cylindrical actuator housing 30,32 includes the first and second actuators, which in this example include the inner pistons 66*a*,68*a* and outer pistons 66*b*,68*b* as described above. As can be seen in FIGS. 17*a* and 17*b*, the actuator housings 30,32 are coaxially arranged external of the bore 23.

The coupling arrangement 34 is arranged to pull the first and second actuator 30,32 housings to one another in a longitudinal direction of the housing 27. Here, the coupling arrangement 34 biases or pulls the first and second actuator housings 30,32 inwards and towards the bore 23 by applying an inwardly directed force and/or load, e.g. a force and/or load towards the bore 23, on the first and second actuator housings 30,32.

In FIG. 17*b*, the inner and outer pistons 66*a*,68*a*,66*b*,68*b* have been hydraulically actuated to move the gates 64*a*,64*b* into the closed positions, as described above. As can be seen in FIG. 17*b* in the closed position the inner pistons 66*a*,68*a* have been actuated outwards, so as to extend from their respective actuator housings 30,32. The inner pistons 66*a*, 68*a* can exert an outwards directed force and/or load, e.g. a force and/or load directed away from the bore 23, on the first and second actuator housings 30,32 in use. In use, a force and/or load exerted by the coupling arrangement 34 on the first and second actuator housing 30,32 is in an opposite or reversed direction to a force and/or load exerted on the first and second actuator housings 30,32 by the actuation of the inner pistons 66*a*,68*a*. when the gates are moved to the closed position.

Here, the coupling arrangement 34 minimises and/or prevents movement, such as outwards movement, of the first and second actuator housings 30,32 when the gates 64,64*b* are moved and/or actuated from the open position to the closed position of the bore 23 by the respective inner and outer pistons 66*a*,68*a*,66*b*,68*b*. As can be seen in FIGS. 17*a* and 17*b*, the coupling arrangement 34 is provided external of the bore 23, extending along a longitudinal direction of the housing 27. The coupling arrangement provides an efficient load path between the first and second actuator housings 30,32. The coupling arrangement avoids the use of flanges or the like for coupling the actuator housings 30,32 to the bore 23, which leads to a reduction in weight of the wellbore control apparatus.

In this embodiment, the coupling arrangement includes six elongate members or tie arrangements, three of which are shown in FIGS. 17*a* and 17*b*, indicated by reference numeral 35. It will be appreciated that in further embodiments, such as those shown in FIGS. 2 and 10, there may be provided more or less than six elongate members 35. The elongate members 35 are arranged parallel to one another in this example. Each of the tie arrangement 35 includes a first tie portion or rod 36*a* and a second tie portion or rod 36*b*. As can be seen in FIGS. 17*a* and 17*b* the first and second tie portions 36*a*,36*b* extend from the respective first and second actuator housings 30,32.

The coupling arrangement 34 includes six connection members or turn buckles 38, three of which are shown in FIGS. 17*a* and 17*b*, for connecting together the respective first and second tie portions 36*a*,36*b* of elongate members 35. It will be appreciated that in further examples, such as those shown in FIGS. 2 and 10, there may be provided more or less than six connection member 38. Each turn buckle 38 and each of the first and second tie portions 36*a*,36*b* have screw threads, such as left hand and right hand screw threads as in this example, so that rotation of the turn buckles 38 can pull the first and second actuator housings 30, 32 together.

Rotating the turn buckles permits tension between first and second actuator housings 30,32 to be adjusted or varied. For example, tension between the first and second actuator housings 30,32 may be varied by rotating the turn buckles 38 to pull the first and second actuator housings 30,32 together or rotating the turn buckles 38 to release tension between the first and second actuator housings 30,32.

Figure 18A:
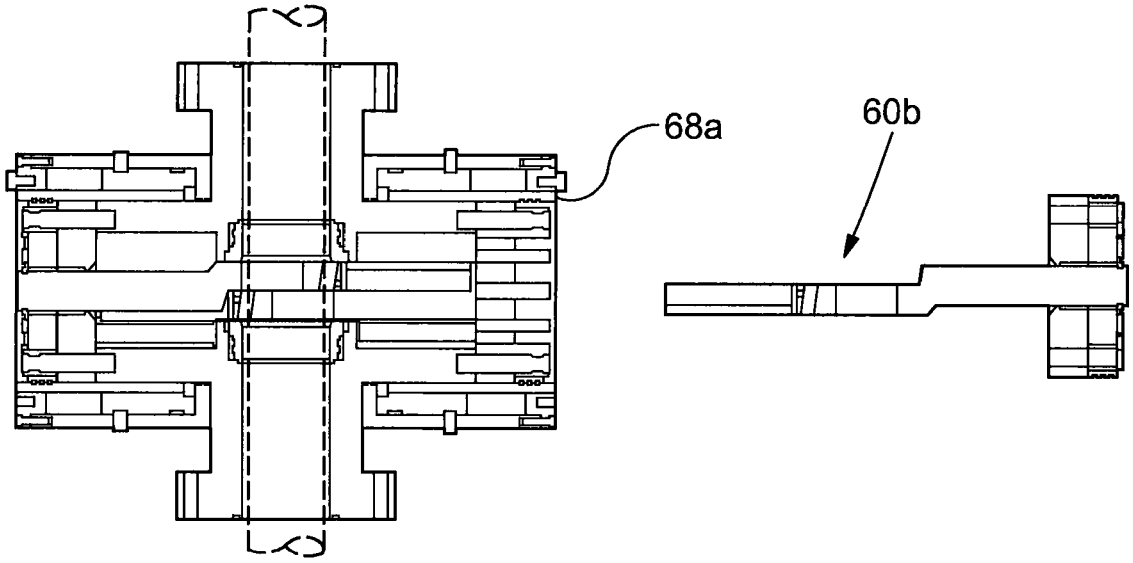
FIGS. 18*a* and 18*b* depict similar views to FIGS. 15*a* and 15*b* but with gate rod and sealing gate removed to illustrate accessibility to the interior.
Figure 18B:
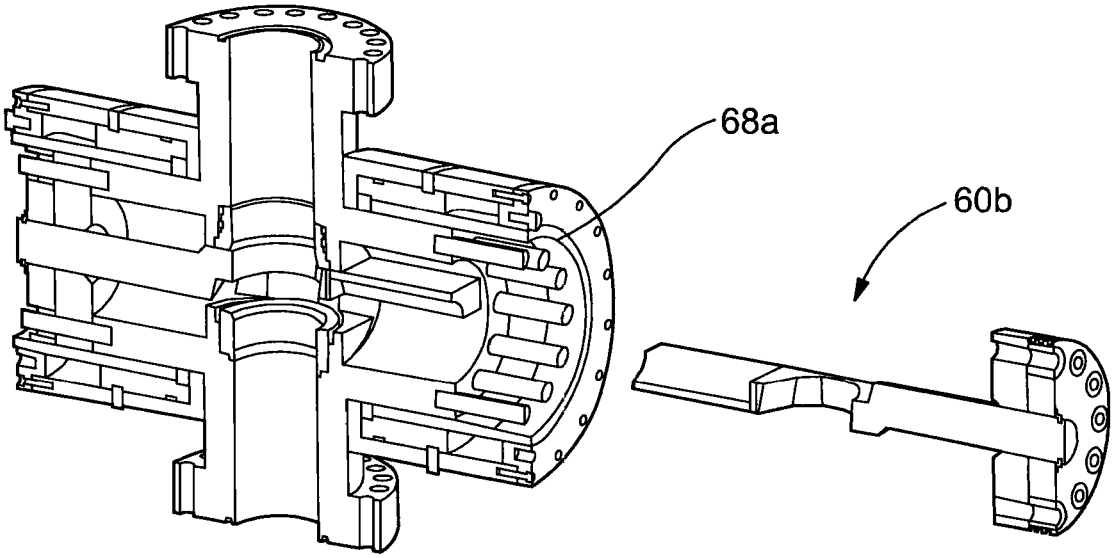

Reference is now made to FIGS. 18*a* and 18*b* of the drawings where, in a manner similar to that shown and described with reference to FIG. 13, an end plate and associated shear ram assembly is shown removed to allow access to the interior of the apparatus. This is enabled by providing the actuators 66*a*, 68*a* as hollow pistons around the closing body, which are the gates, so that the pistons and gates are effectively in parallel rather than in series. This structure has the advantage of shortening the overall length of the arrangement compared to an arrangement where the piston and gate are in series and furthermore, because the ram is mounted on the butt plate, removal of the butt plate and ram is not hindered or disrupted by the location of the actuator, which means that, as shown in FIGS. 15*a* and 15*b*, the assembly and gates can be removed with the actuator remaining in situ. Similarly, it will also be appreciated that it is possible to disconnect the piston actuator from the gate and rod thereby allowing the actuator to be function tested in isolation without operating the gate. Furthermore, the shear ram rod which provides transmission for the stroke of the valve gate can remain in situ while the actuator is removed providing the significant advantage of eliminating any requirement to disturb the pressure integrity of the valve when servicing or removing the actuator.

Operation of the outer piston arrangement show in FIGS. 1 to 18 will now be described in detail with reference to FIGS. 19*a* to 19*e*. It will be appreciated that as pistons are controlled by hydraulic fluid it is important to provide a control system that ensures that the inner and outer pistons afore described are maintained in position and do not reciprocate in the event of a hydraulic failure. This is provided using a control mechanism locking the position of the reciprocating piston within a hydraulic cylinder.

With reference to FIGS. 19*a* to 19*e* which show the outer piston 66*b* at various stages of actuation, it will be seen that the hydraulic cylinder has two actuating volumes 82, 84 which are isolated by the outer piston 66*b*, 68*b*, one volume 82 for extending the piston and the other volume 84 for retracting the piston. The piston has a sealing arrangement provided by the seals 86, 88 which separate the actuating volumes 82, 84 and also isolates and defines a third volume 90 which exists between the piston seals 86, 88. This third volume 90 travels with the piston as it moves within the housing on main volume defined between the outer cylinders 30, 32 and the main body of the apparatus 28 as can be best seen in FIGS. 14*a* and 14*b*.

The volume 90 is controlled independently as the two actuating volumes 84, 86 and is pressurised hydraulic fluid via a port 92. Pressuring this volume controls a series of circumferentially disposed locking dogs 72. As shown in all of the diagrams aforementioned, it will be understood that each locking dog is sprung loaded with a spring washer (not shown in the interests of clarity) which means that each locking dog is biased into engagement with one of the piston bearing grooves 94, thus locking the piston in one of two positions i.e. either in the closed position or in the open position. Applying hydraulic pressure to the volume 90 will force the locking dogs against the spring washers moving them out of engagement with the bearing groove 94 and allowing actuation of the outer inner piston and the rams to move between the open and closed positions as afore described.

Figure 19A:
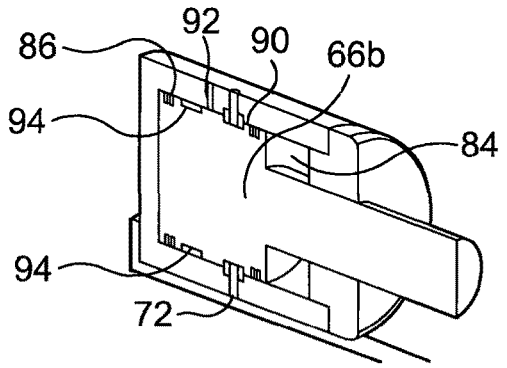
FIGS. 19*a*, 19*b*, 19*c*, 19*d* and 19*e* depict a mechanism for locking the position of a reciprocating piston within a hydraulic cylinder to illustrate a method which is used in locking the position of the actuators and thus the sealing gates in the apparatus of FIGS. 1 to 18.
Figure 19B:
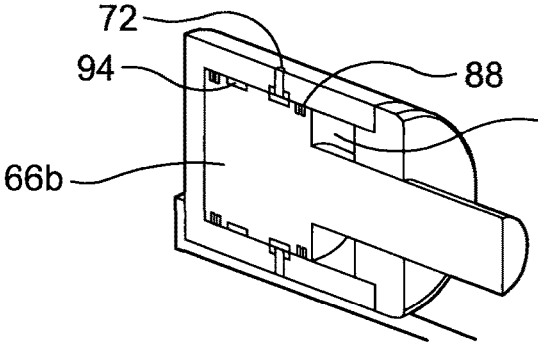
Figure 19C:
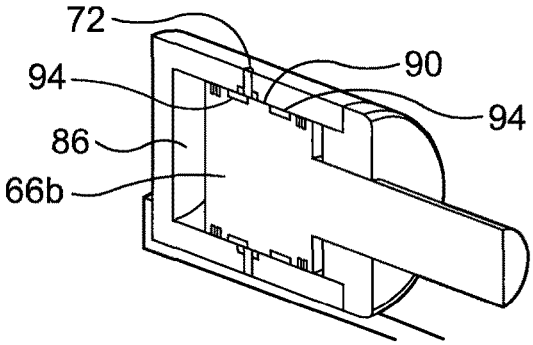
Figure 19D:
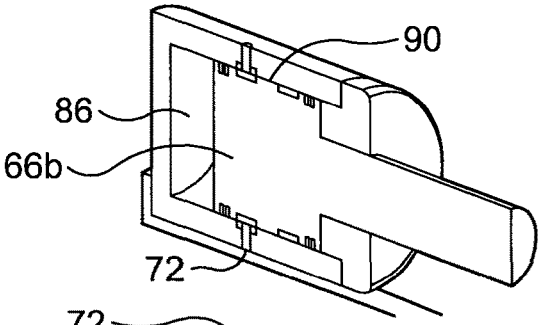
Figure 19E:
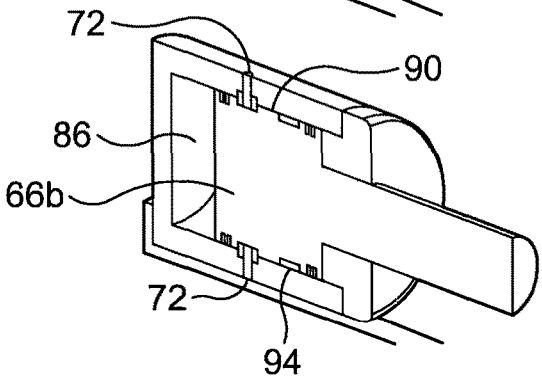

In FIG. 19*a* it will be seen that the piston is locked in a retracted position such that the dogs are biased into groove 94. Hydraulic pressure is applied via line 92 to force the locking dogs to retract as shown in FIG. 19*b*. This allows hydraulic pressure to be applied to volume 86 to extend the piston as shown in FIG. 19*c*. When hydraulic pressure is released from volume 1 and volume 3 the locking dogs are spring biased in position such that the dogs engage with groove 94. This prevents the piston from recoiling in the event of hydraulic failure.

Reference is now made to FIGS. 20*a*, 20*b* and FIGS. 21*a*, 21*b* which explain how the butt plates are retained within the inner piston actuator and how the butt plates are then removed so that the ram assembly can provide access to the interior of the apparatus as described with reference to FIGS. 12*a*, 12*b*.

Figure 20A:
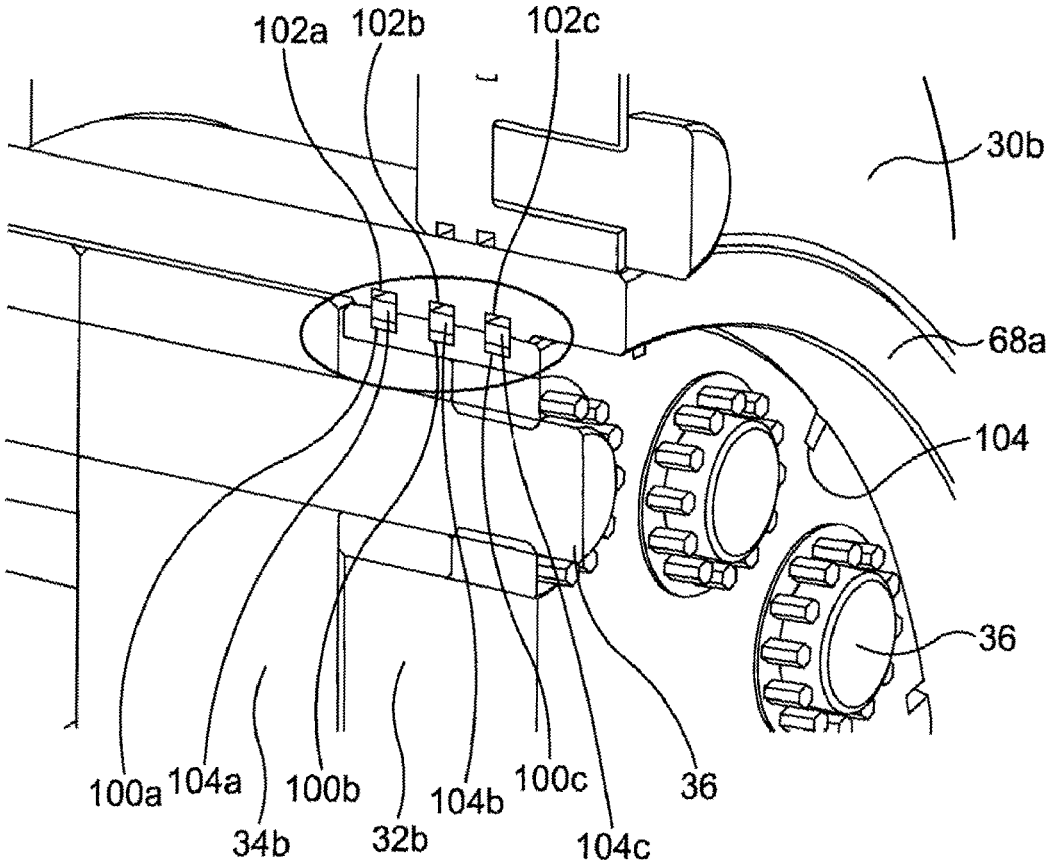
FIG. 20*a* is an enlarged detail of part of the apparatus shown in FIG. 6 in broken outline with, in a perspective view taken in the direction of arrow 13 and depicting the engagement of the end plate with the actuator housing.
Figure 20B:
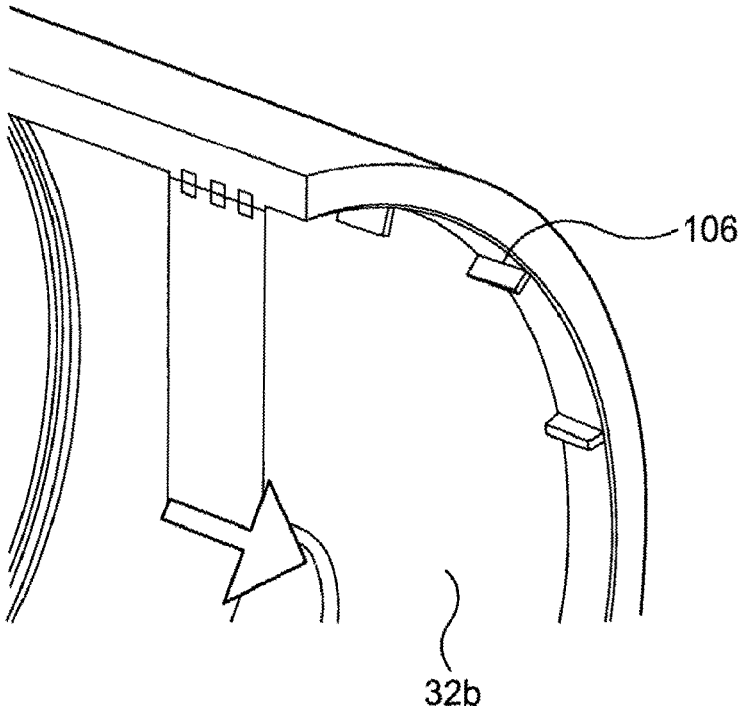
FIG. 20*b* depicts an illustrative view of how inserts can be used to remove an end butt plate.
Figure 21A:
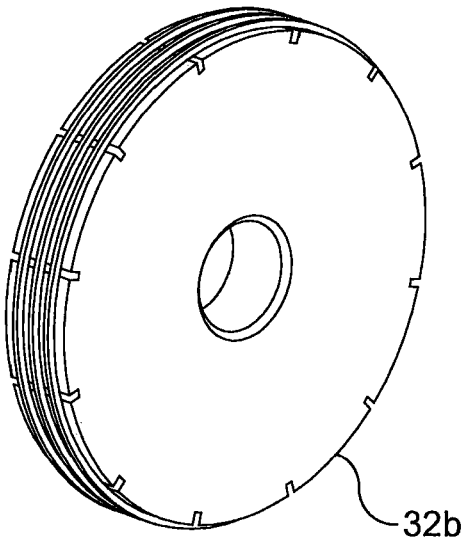
FIGS. 21*a*, 21*b*, 21*c* and 21*d* depict the end plate with C-rings in place and illustrating in sequence how wedges can be inserted into slots for engagement with C-rings and removal of the end plate to provide access to the interior.
Figure 21B:
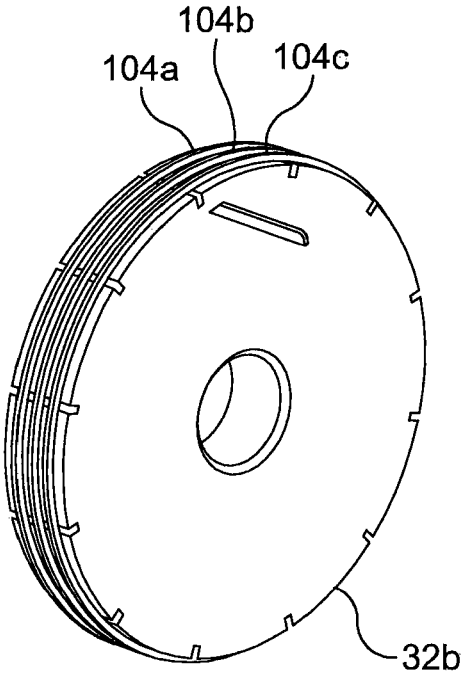
Figure 21C:
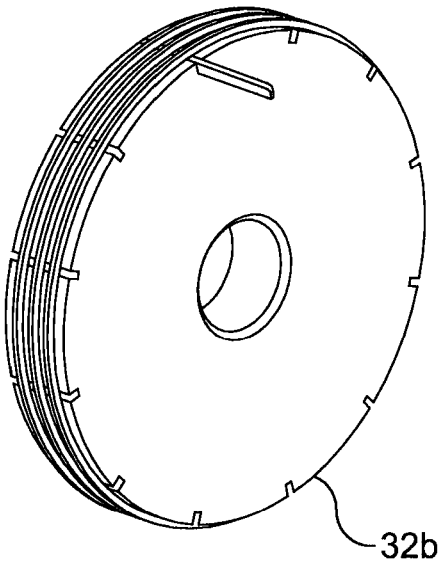
Figure 21D:
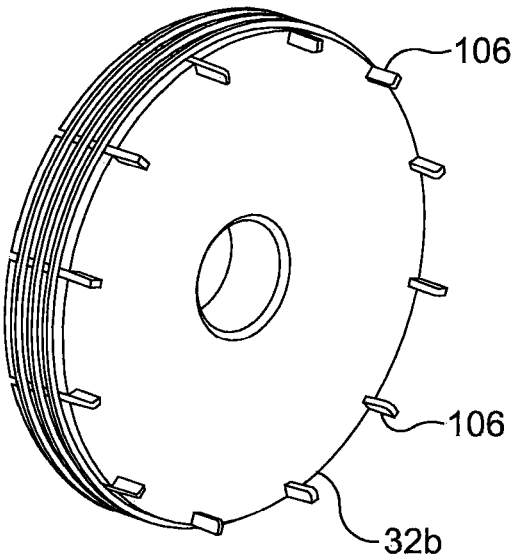

Referring first to FIG. 20*a*, it will be seen that the end plate and the actuator has three spaced square section grooves 100*a, b, c*, 102*a, b, c* and there is a C-ring 104*a, b, c* disposed in each pair of grooves shown. It will be appreciated that the grooves are large enough to accommodate the C-rings shown but are also large enough to allow displacement of the C-rings either to the butt plate 32*b* or to the actuator as will be described. This is achieved by providing slots 104 in the butt plate which are disposed around the periphery of the butt plate. The slots extend through the butt plate and allow wedges to be inserted so that once the wedges 106 (FIG. 20*b*) are inserted the C-rings are displaced into the grooves in the inner actuator piston and this allows the stud and nuts to be turned and release the butt plate 32*b* which carries the shear ram assembly 60*a*. The wedges 104 when inserted allow removal of the butt plate 32*b* in the direction of the arrow shown in FIG. 20*b*.

It will be appreciated that various modifications may be made to the embodiment of the apparatus and parts thereof herein before described without departing from the scope of the invention.

For example, it will be appreciated that the gate blocks 64*a*, 64*b* need not be tapered, although the provision of tapered gate blocks provides the aforementioned advantage of energising the seals, so that once the valve is closed an extremely robust seal is provided for low pressure fluids and low density fluids, thus providing better seal integrity.

The material of the blades may be Inconel or any equivalent hard material sufficient to cut through tubulars and the like. The axial slots 104 which intersect the circumferential groves as shown in FIGS. 20 to 21 could also be placed in the actuator as well as or instead of the end plate 32*b*. It will also be understood that the C-rings 102 may be displaced by other methods such as providing a cam shaft with surfaces which abut each of the C-rings and location of the cam shaft could displace the C-rings into the groves either on the actuator or on the end plate to allow the end plate to be removed.

It will thus be appreciated that the aforementioned apparatus provides significant advantages over the art in terms of providing energised seal integrity and ease of access to allow maintenance of the interior of the apparatus. The arrangement is such that either the actuator can be removed to leave the gate in place, thus ensuring seal integrity or the shear ram can be removed allowing replacement of blades and seals facilitating rapid maintenance and significantly reduced time and therefore expense than with existing arrangement. The structure herein before described is applicable to various sizes of apparatus from the 5" to 7" inch product all the way to an 18¾ inch product, all of which operate on a similar principle as the aforementioned embodiment. For example, ribs 37 may be declined with respect to a longitudinal axis A of the housing 27.

For example, the recesses 69*a*,69*b* may be decline with respect to a longitudinal axis B of the upper and/or lower gate 64*a*,64*b*.

The invention claimed is:

1. A well bore control apparatus comprising:

a housing having a guide element defining a path, the housing defining a throughbore for receiving a tubular;

a first tapered gate and a second tapered gate located within the housing, the first and second tapered gates being adapted to engage with the guide element, wherein in use the first and second tapered gates are moveable by an actuation force along the path defined by the guide element in a direction substantially transverse to the throughbore between an open position of the throughbore and a closed position of the throughbore, wherein a taper of the first tapered gate engages a taper of the second tapered gate, when the first and second tapered gates are closing or are in the closed position; and a first seal seat for forming a first seal with the first gate in the closed position to seal the throughbore; and wherein the guide element is arranged, in use, to actuate the first tapered gate into sealing engagement with the first seal seat in the closed position.

2. A well bore control apparatus according to any claim 1, wherein the first tapered gate and the second tapered gate are tapered along a direction of travel.

3. A well bore control apparatus according to claim 1, wherein, as the first tapered gate and the second tapered gate move, the tapers pass over each other to create a displacement component of motion which is perpendicular to the direction of actuation.

4. A well bore control apparatus according to claim 1, wherein the well bore control apparatus includes a second seal seat adapted for forming a second seal with the second tapered gate in the closed position to seal the throughbore.

5. A well bore control apparatus according to claim 4, wherein the guide element is arranged, in use, to actuate the first and/or second tapered gate into sealing engagement with the second seal seat in the closed position.

6. A well bore control apparatus according to claim 5, wherein the throughbore is sealed when either the first or the second tapered gate is in the closed position.

7. A well bore control apparatus according to claim 5, wherein the throughbore is sealed when both the first and second tapered gates are in the closed position.

8. A well bore control apparatus according to claim 1, wherein the first and/or second seal minimises or prevents flow of fluids, such as well bore fluids, through the throughbore.

9. A well bore control apparatus according to claim 1, wherein in the closed position the first and/or second tapered gate abuts the respective first and/or second seal seats to form the first and/or second seals.

10. A well bore control apparatus according to claim 1, wherein the guide element is arranged in the housing in a substantially transverse direction to the throughbore.

11. A well bore control apparatus according to claim 1, wherein the guide element is inclined or declined with respect to a longitudinal axis of the housing.

12. A well bore control apparatus according to claim 1, wherein the guide element is arranged within the housing to define an acute angle to a longitudinal axis of the housing.

13. A well bore control apparatus according to claim 1, wherein the guide element has a plurality of protrusions, recesses and/or grooves, such as elongated protrusions, recesses and/or grooves, arranged in the housing in a substantially transverse direction to the throughbore.

14. A well bore control apparatus according to claim 1, wherein the housing comprises a first and a second guide element, provided in the housing so as to oppose one another.

15. A well bore control apparatus according to claim 14, wherein the first and/or second tapered gate has a first and a second engagement element provided on opposing sides or surfaces of the first and/or second tapered gate for mating, interoperating and/or co-acting with the respective first and second guide elements of the housing.

16. A well bore control apparatus according to claim 1, wherein the first and/or second tapered gate is adapted to engage with the guide element.

17. A well bore control apparatus according to claim 1, wherein the first and/or second tapered gate includes an engagement element, arranged for mating, interoperating and/or co-acting with the guide element of the housing.

18. A well bore control apparatus according to claim 17, wherein the engagement element has a plurality of further protrusions, recesses and/or grooves for mating, interoperating and/or co-acting with the respective plurality of protrusions, recesses and/or grooves of the guide element.

19. A well bore control apparatus according to claim 17, wherein the engagement element is in line with the taper of the first and/or second tapered gate.

20. A well bore control apparatus according to claim 17, wherein the engagement element is inclined or declined with respect to a longitudinal axis of the first and/or second tapered gate.

21. A well bore control apparatus according to claim 1, wherein the first and/or second tapered gate includes a first and/or second metal tapered gate.

22. A well bore control apparatus according to claim 1, wherein the first and/or second seal seat include a first and/or second metal seal seat.

23. A well bore control apparatus according to claim 1, wherein in the closed position, the first and/or second tapered gate engages or abuts the respective first and/or second seal seat to form a respective first and/or second metal to metal seal.

24. A well bore control apparatus according to claim 1, wherein in the closed position, the first and/or second tapered gate engages or abuts the guide element and/or the housing to form a further first and/or second seal between the first and/or second tapered gate and the guide element and/or the housing.

25. A method of servicing the interior of a well bore control apparatus as claimed in claim 1, said method comprising the steps of removing an end cover of a well bore control apparatus, said end cover being coupled to a shear ram assembly, removing said end cover and said shear ram assembly to permit replacement of a cutting blade, a tapered sealing gate or a valve seal.

26. A method for sealing a well bore, the method comprising:

providing a well bore control apparatus including a housing having a guide element defining a path, the housing defining a throughbore for receiving a tubular, a first tapered gate and a second tapered gate located within the housing, the first and second tapered gates being adapted to engage with the guide element, and a first seal seat;

actuating or moving the first and/or second tapered gate in a direction transverse to the throughbore from an open position of the throughbore to a closed position of the throughbore, wherein the taper of the first tapered gate engages a taper of the second tapered gate when the first and second tapered gates are closing or are in the closed position;

engaging the first tapered gate with the first seal seat;

forming a first seal between the first tapered gate and the first seal seat to seal or close the throughbore; and wherein the first tapered gate is actuated by the guide element into sealing engagement with the first seal seat in the closed position.

* * * * *